US010092068B2

(12) United States Patent
Jung et al.

(10) Patent No.: US 10,092,068 B2
(45) Date of Patent: Oct. 9, 2018

(54) LENGTH ADJUSTMENT DEVICE

(71) Applicants: DONG-IN ENTECH CO., LTD., Gimpo-si, Gyeonggi-do (KR); Myeong A Lee, Goyang-si, Gyeonggi-do (KR)

(72) Inventors: In Soo Jung, Goyang-si (KR); Myeong A Lee, Goyang-si (KR)

(73) Assignees: DONG-IN ENTECH CO., LTD., Gimpo-si, Gyeonggi-do (KR); Myeong A. Lee, Goyang-si, Gyeonggi-do (KR)

( * ) Notice: Subject to any disclaimer, the term of this patent is extended or adjusted under 35 U.S.C. 154(b) by 0 days.

(21) Appl. No.: 15/720,456

(22) Filed: Sep. 29, 2017

(65) Prior Publication Data

US 2018/0184769 A1 Jul. 5, 2018

(30) Foreign Application Priority Data

Jan. 5, 2017 (KR) ..... 10-2017-0002077
Feb. 7, 2017 (KR) ..... 10-2017-0016783

(51) Int. Cl.
*A45B 9/00* (2006.01)
*A45B 9/02* (2006.01)
*A63B 29/08* (2006.01)

(52) U.S. Cl.
CPC ..... *A45B 9/02* (2013.01); *A45B 2009/007* (2013.01); *A63B 29/08* (2013.01); *A63B 2210/58* (2013.01); *A63B 2225/093* (2013.01)

(58) Field of Classification Search
CPC ..... A45B 2009/007; A61H 3/00; A61H 2003/001; E04F 11/1863
See application file for complete search history.

(56) References Cited

U.S. PATENT DOCUMENTS 2,838,266 A * 6/1958 Rees ..... E05C 17/30 248/354.1
5,036,873 A * 8/1991 Clayton ..... A61H 3/02 135/69
6,354,629 B1 3/2002 McNeal et al.
6,782,903 B1 8/2004 Jarman et al.
7,650,898 B2 1/2010 Jarman et al.
7,775,902 B2 * 8/2010 Churovich ..... A63B 53/00 403/297
8,006,711 B2 8/2011 Pietrzak et al.
8,875,724 B2 * 11/2014 Nootenboom ..... A45B 9/00 135/65
2002/0141812 A1 10/2002 Edelen et al.
(Continued)

FOREIGN PATENT DOCUMENTS

EP 1321174 A1 6/2003
EP 2158009 B1 3/2010
(Continued)

OTHER PUBLICATIONS

The International Search Report dated Nov. 1, 2017; PCT/KR2017/009289; *The English Translation of the ISR is not yet available from WIPO*.

*Primary Examiner* — Noah Chandler Hawk
(74) *Attorney, Agent, or Firm* — Ladas & Parry LLP

(57) ABSTRACT

A length adjustment device according to an exemplary embodiment forms a latching groove on an interior circumference of a first extension pole, which is configured to be separately assembled, and there is an effect that a manufacturing becomes easy and a mass production is possible.

5 Claims, 28 Drawing Sheets

(56) References Cited

U.S. PATENT DOCUMENTS

| | | | | |
|---|---|---|---|---|
| 2010/0254751 | A1* | 10/2010 | McMillan, III ..... | A45B 9/00<br>403/109.1 |
| 2015/0059816 | A1* | 3/2015 | Kim ..... | A45B 9/00<br>135/75 |
| 2016/0201706 | A1 | 7/2016 | Heim | |

FOREIGN PATENT DOCUMENTS

| | | | |
|---|---|---|---|
| EP | 2175942 | B1 | 4/2010 |
| EP | 2842612 | B1 | 3/2015 |
| JP | 2004-215918 | A | 8/2004 |
| KR | 20-0219048 | Y1 | 1/2001 |
| KR | 101261783 | B1 | 4/2013 |
| KR | 10-1366722 | B1 | 2/2014 |
| KR | 1020160125124 | A | 10/2016 |
| KR | 1020160141006 | A | 12/2016 |
| KR | 1020160150447 | A | 12/2016 |
| WO | 2013/162180 | A1 | 10/2001 |

* cited by examiner

LOCK

OPEN

LENGTH ADJUSTMENT DEVICE

CROSS-REFERENCE TO RELATED APPLICATION

The present application claims priority to Korean patent application number 10-2017-0002077 filed on Jan. 5, 2017 and Korean patent application number 10-2017-0016783 filed on Feb. 7, 2017, the entire disclosure of which is incorporated herein in its entirety by reference.

BACKGROUND

Field of Invention

The present invention relates to a length adjustment device.

More particularly, the present invention relates to a length adjustment device that the length thereof is freely adjusted for expansion and retraction, so it can be used conveniently.

Description of Related Art

In general, the length adjustment device is applied to various kinds of products such as mountain climbing sticks, and is designed to be used by adjusting the length according to the user's body and convenience.

A conventional art, patent document is shown in FIG. 1, includes a guide portion 1 that is provided at the lowermost portion as a rubber pad to contact road surface and simultaneously absorb the impact force when the stick is used, a length adjustment portion 2 that is provided so that the lower pole 2*c* to which the guide portion 1 is fixed is inserted or pulled into the upper pole 2*a* and simultaneously is tightened as a nut 2*b* after being adjusted, a horn 3 that is configured in a handle 5 that is fixed to one side of the upper pole 2*a* and is operated according to the operation of a press portion 3*a* projecting outwardly in a certain region, and a luminous band 4 that is configured to surround the upper and lower pole 2*a* and 2*c* and to be easily shown.

However, these conventional art length adjustment device requires much effort in adjusting the height, is very cumbersome to operate, cannot be easily manipulated by females or elderly men, are not easy to operate, take a long time, and in addition, it is inconvenient to stretch and fix the height of the mountain climbing stick as much as the user desires and usability and convenience are deteriorated.

PRIOR ART

Korean Utility-model Laid-Open Publication No. 20-0219048 (disclosed in 2001 Apr. 2)

The above information disclosed in this Background section is only for enhancement of understanding of the background of the invention and therefore it may contain information that does not form the prior art that is already known in this country to a person of ordinary skill in the art.

SUMMARY

The present invention has been made in an effort to provide a length adjustment device having advantages of easily adjusting extension and contraction of the length to be able to be conveniently used.

A length adjustment device according to an exemplary embodiment may include a head having a cap forming an outside portion and a press button including a pushing piece that is disposed on the cap to be extended toward a lower side; a main pole that includes a fixation shaft that is engaged with the cap and an upper end is inserted into the cap to be fixed thereto, a lever shaft that is built in the fixation shaft, an upper end portion is connected with the press button to be lifted or lowered in accordance with a press or a release of the press button, an upper ball cover that is connected with a lower end portion of the fixation shaft and a first fixation ball is mounted on a first fixation hole that penetrates an external circumferential surface, a first ball lever portion that is connected with a lower end portion of the lever shaft to be lifted or lowered together and at least a part of an external circumferential surface is formed to be recessed such that the first fixation ball is inserted into or drawn out of the upper ball cover, and an upper return spring that is disposed in the fixation shaft and is disposed between the first ball lever portion and the upper ball cover to return the first ball lever portion; and a first extension pole that includes a first movement shaft that is inserted into or out of the main pole and moves between the main pole and the fixation shaft, a plurality of first latching grooves are formed on an interior circumference along a length direction, and the movement is locked or unlocked depending on whether the first fixation ball mounted on the upper ball cover is latched or not, a lower ball cover that is attached to a lower end of the first movement shaft and is fitted with a second fixation ball in a second fixation hole penetrated on an external circumferential surface, a second ball lever portion that is installed under the latching groove inside the first movement shaft and contacts the first ball lever portion to move up and down together and at least a portion of an external circumferential surface is recessed so that the second fixation ball is inserted into or drawn out of the lower ball cover, and a lower return spring that is disposed between the lower ball cover and the second ball lever portion to return the second ball lever portion and that is disposed in the first movement shaft.

Specifically, the press button includes a lock piece that is extended in a lower side and is disposed to be parallel to the pushing piece, and the head further includes a lock button that is connected with or detached from an external circumferential surface of the pushing piece and allows or prevent the descent of the lock piece to perform a locking operation or an opening operation.

Specifically, the cap includes an upper mounting groove that the press button is disposed, a lower mounting groove that an upper end portion of the fixation shaft is inserted to be fixed thereto, a fastening portion that is disposed at a lower portion and the main pole is coupled to, a drawing hole that one end portion of the lock button is drawn out, and a webbing groove that a webbing strap is coupled to.

Specifically, the webbing strap includes an adjustment portion for adjusting each length of both sides strap to be able to adjust a length regardless of a position of hand.

Specifically, the first and second fixation groove and the first and second fixation ball have circular arc shape.

Specifically, a coupling pipe is disposed at a lower end portion of the main pole, a rotation nut that a lower portion is tapered downwards is connected with an outside of the coupling pipe, and the first extension pole that is drawn out by a pressure can be fastened and fixed, if the rotation nut is rotated.

Specifically, further includes a second extension pole that is inserted into or withdrawn out of the first extension pole, moves between the first extension pole and the first movement shaft, a second latching groove is formed on an interior circumference along the length direction, and the movement is locked or unlocked depending on whether the second fixation ball that is disposed on the lower ball cover is latched or not.

Specifically, the first extension pole includes a first connection portion that is formed at an upper end portion, a first anti shock support ring that is formed at a lower side of the first connection portion, and a first anti shock spring that is disposed between the first connection portion and the first anti shock support ring to prevent an impact between the first extension pole and the main pole, and includes a second anti shock spring that is disposed in the first movement shaft and is disposed between the second ball lever portion and the lower ball cover to prevent an impact between the first extension pole and the second extension pole.

Specifically, the first movement shaft is separately prepared, and the separated line may be formed on a plurality of first latching groove.

In a length adjustment device according to a present invention, length stretching and fixing can be freely adjusted as desired with a press button, a ball cover and a ball body are on an upper and lower sides and a circular arc shaped fixation ball is interposed between them, a detailed length adjustment for a first and a second extension poles is possible and the locking force is increased, and an anti-shock spring realizes a flexible effect against the ground when controlling the length.

Also, in a length adjustment device according to a present invention, a length of the entire device can be easily changed by using a force of an upper and a lower extension springs by an operating of only one press button, It is convenient because it can be easily fixed with a small force after stretching the device as much as desired, the length adjustment works is smoothly performed, adjustment portions are formed on both straps so that length adjustment becomes easy regardless of the hand holding the device, and It can be quickly operated and responded in various usage environments, and has excellent usability and convenience.

Also, in a length adjustment device according to a present invention forms a latching groove on an interior circumference of a first extension pole, which is configured to be separately assembled, and there is an effect that a manufacturing becomes easy and a mass production is possible.

DETAILED DESCRIPTION

Figure 1:
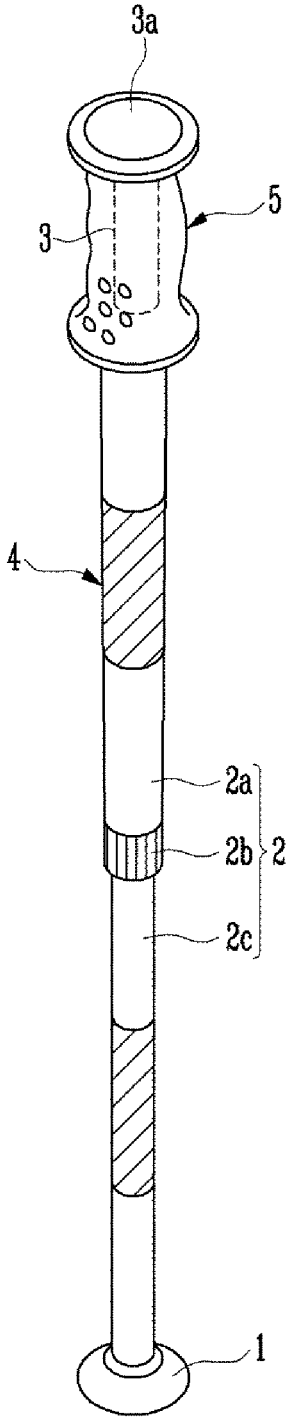
FIG. 1 is a perspective view of a conventional length adjustment device.

The purpose, specific merits, and novel features of the present invention will become more apparent from the following detailed description and preferred exemplary embodiments with reference to the accompanying drawings. In this specification, it should be noted that in adding reference numerals to the constituent elements of each drawing, if possible, the same constituent elements have the same number, even though they are displayed on different drawings. Also, describing the present invention, a detailed description of the related known art may be omitted if it is determined that the essence of the present invention may be unnecessarily blurred.

Hereinafter, referring to the drawings, the preferred embodiment of the present invention will be described in detail.

Figure 2A:
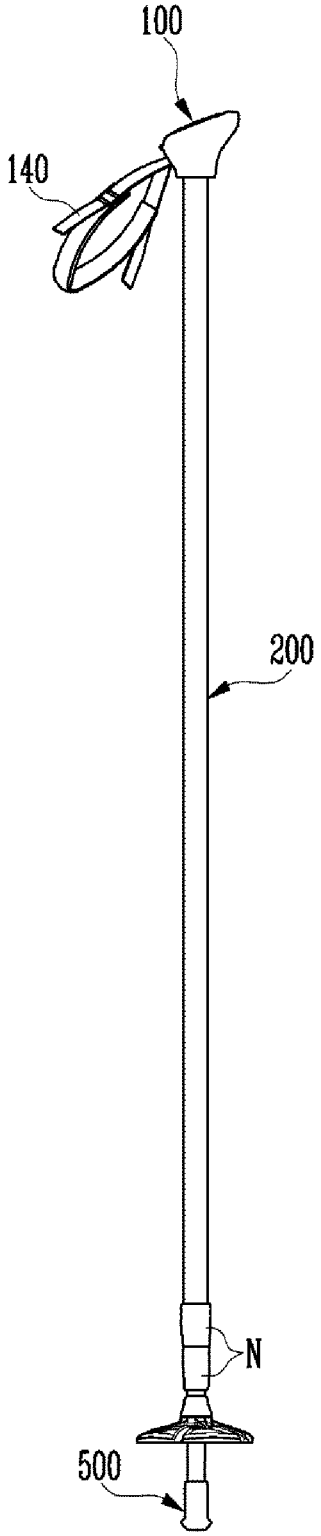
FIG. 2A is an exterior perspective view when folding a length adjustment device according to an exemplary embodiment of the present invention.
Figure 2B:
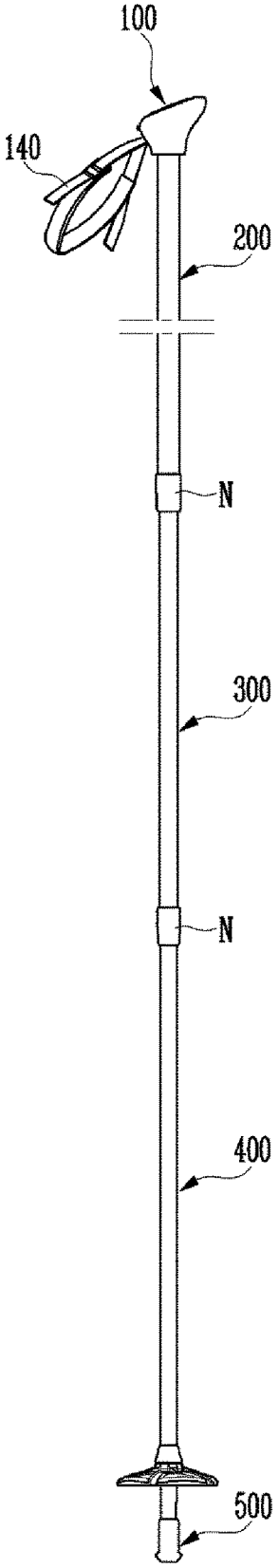
FIG. 2B is a perspective view when extending a length adjustment device according to an exemplary embodiment of the present invention.

As shown in FIG. 2A and FIG. 2B, a length adjustment device according to the present invention is designed to be applied to various kinds of products such as a mounting climbing sticks and to adjust the length according to the user's body and convenience includes a head 100, a main pole 200, a first extension pole 300, and a second extension pole 400.

Figure 3A:
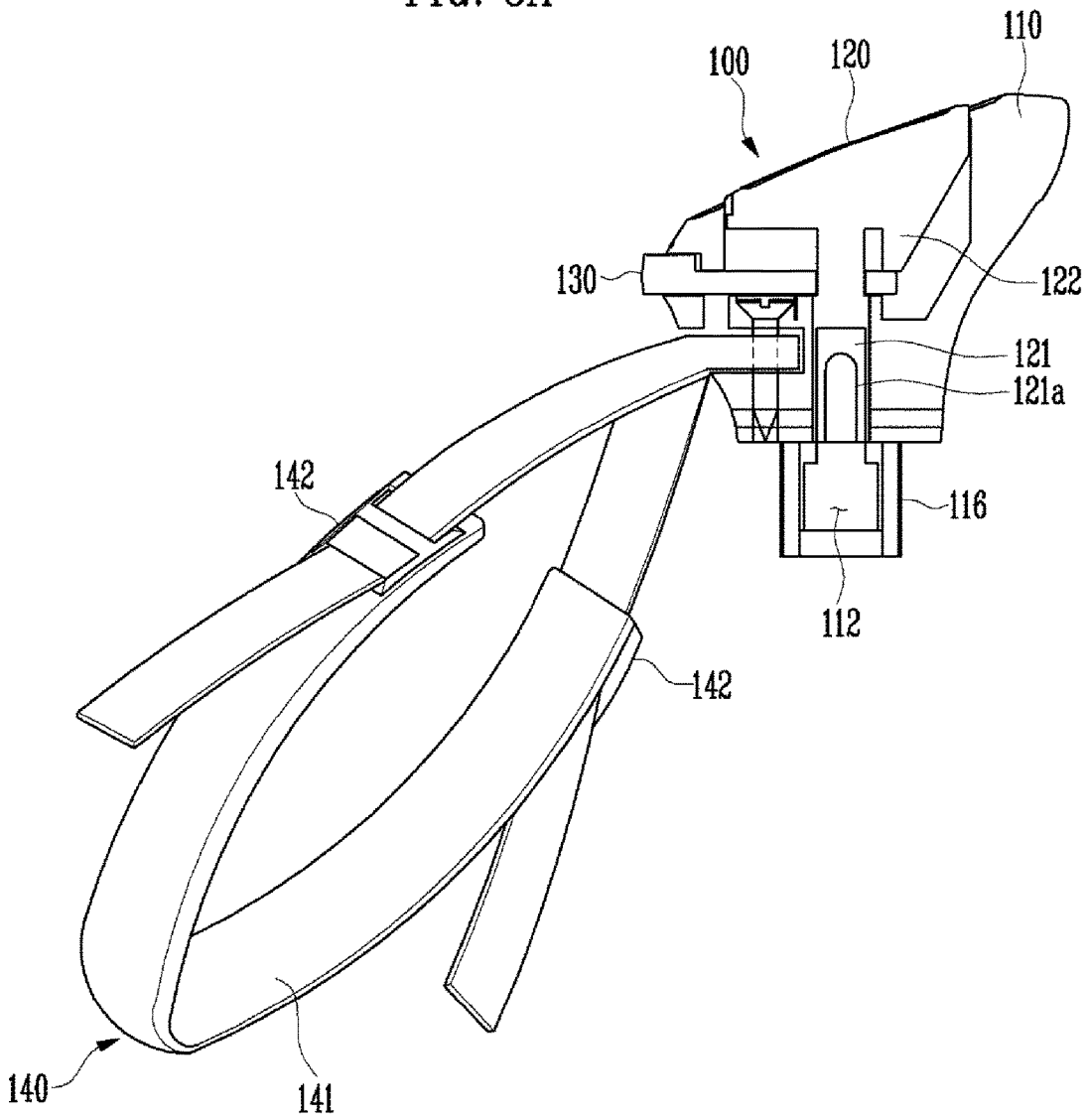
FIG. 3A is a cross-sectional view showing the configuration of a head according to an exemplary embodiment of the present invention.
Figure 3B:
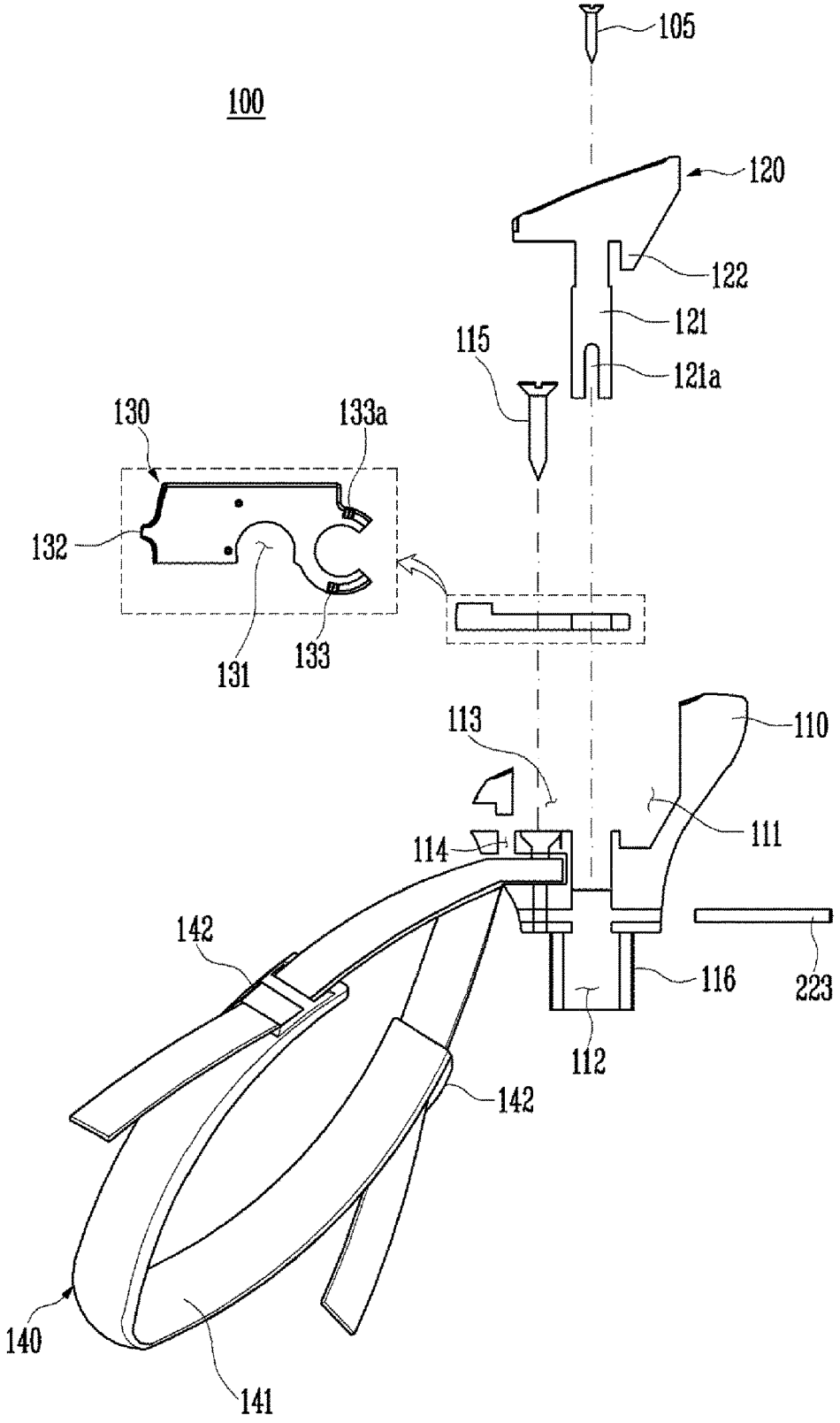
FIG. 3B is a drawing that separates each constituent element of the head according to an exemplary embodiment of the present invention.

Referring to FIG. 3A and FIG. 3B, a head 100 includes a cap 110 forming the outer periphery thereof, an upper mounting groove 111 is formed on an upper portion of the cap 110, and a press button 120 is inserted therein, a lower mounting groove 112 is formed at a lower portion of the cap 110 so that the upper end of the fixation shaft 220 is inserted and fixed thereto, a drawing hole 113 is formed on one side, a lock button 130 is coupled to the cap 110, and one end thereof is drawn out, and a webbing groove 114 is formed on one side and a part of the webbing strap 140 is inserted thereto to be coupled by a coupling bolt 115. A fastening portion 116 is formed at a lower portion of the cap 110 so that a main pole 200 is fastened to an external circumferential surface of a fastening portion 116, and the coupling method can be variously configured, for example, may be a screw type.

A press button 120 is mounted on a cap 110, An upper surface of the press button 120 is formed to be inclined toward the front lower side so that the user can easily grasp the press button 120 and the press button 120 functions as a handle that an user easily grasps, and a pushing piece 121 and a lock piece 122 are respectively extended toward a lower side. A pushing piece 121 is longer than that of a lock piece 122, a slit-shaped press hole 121*a* is formed, when a user presses a press button 120, a pushing button 120 applies a force to a lever shaft 210 just below to be able to be lowered.

A connection hole 131 is formed at a middle portion of a lock button 130 to surround and contact an external circumferential surface of a pushing piece 121, an operation piece 132 is formed at one end portion and is drawn out through a drawing hole 113 to be rotated by an user, a restriction piece 133 that an opening hole 133*a* is formed at the other end portion is prepared, if an operation piece 132 is operated to be rotated, a lock piece 122 controls a press of a press button 120 by a restriction piece 133 or a lock piece 122 penetrates a lower side of an opening hole 133*a* to realize an opening.

Figure 4A:
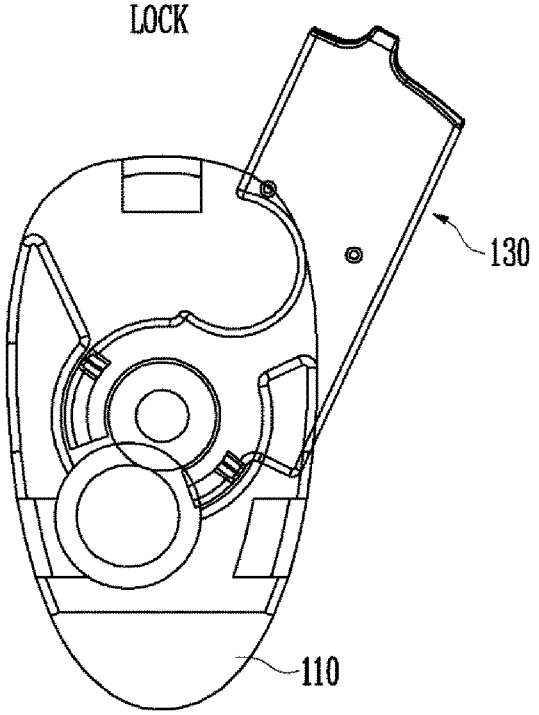
FIGS. 4A and 4B are a drawing illustrating a locking and an open operation of a lock button according to an exemplary embodiment of the present invention.
Figure 4B:
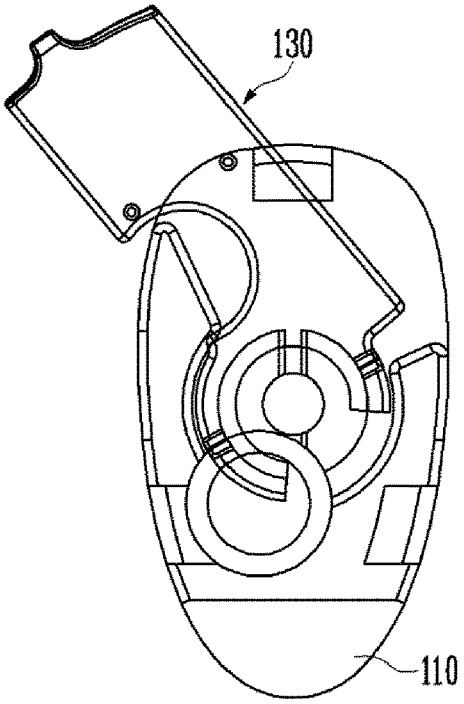

That is, referring to (a) of FIG. 4, if an operation piece 132 is rotated to "LOCK" direction, a restriction piece 133 rotates, and because a lock piece 122 is disposed on a restriction piece 133, a press operation of a press button 120 is controlled. Conversely, when the operation piece 132 is rotated in an "OPEN" direction, the restriction piece 133 is rotated, and the lock piece 122 is positioned on the opening hole 133*a* having the open state so that the push button 120 can be pressed.

At this time, a return spring (not shown) is installed at an external circumference of a pushing piece 121 so that a pressed button 120 can be smoothly returned to an upper side.

In the webbing strap 140, straps 141 of both sides are connected to be connected with each other, Each strap 141 is provided with an adjustment portion 142 such as a buckle for adjusting the length, and an length adjustment of the webbing strap 140 can be performed easily regardless of right hand or left hand in a condition holding a length adjustment device. A coupling hole is formed at one end portion of a webbing strap 140 to be coupled to a webbing groove 114 through a coupling bolt 115.

Figure 5A:
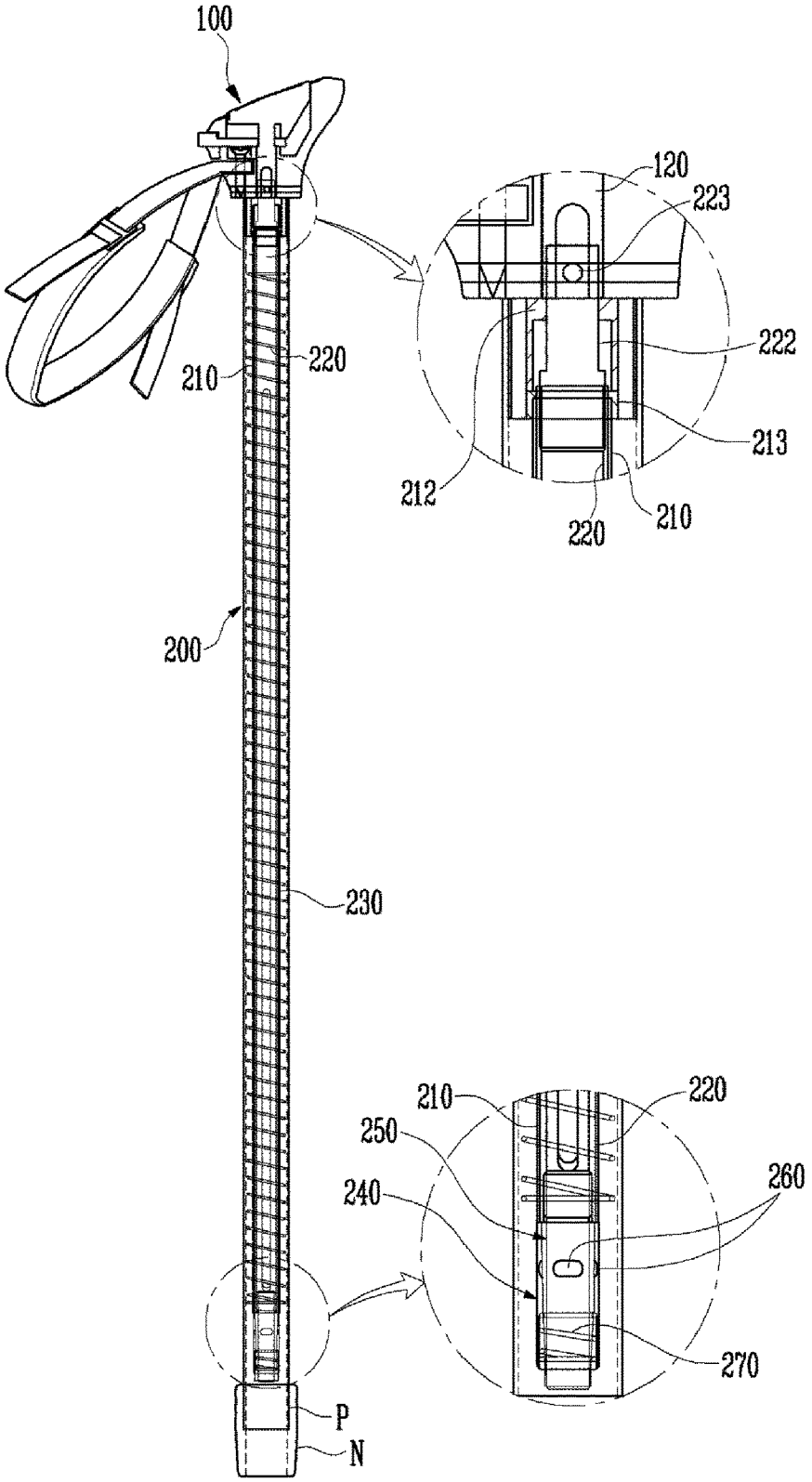
FIG. 5A is a cross-sectional view of the main pole according to an exemplary embodiment of the present invention.
Figure 5B:
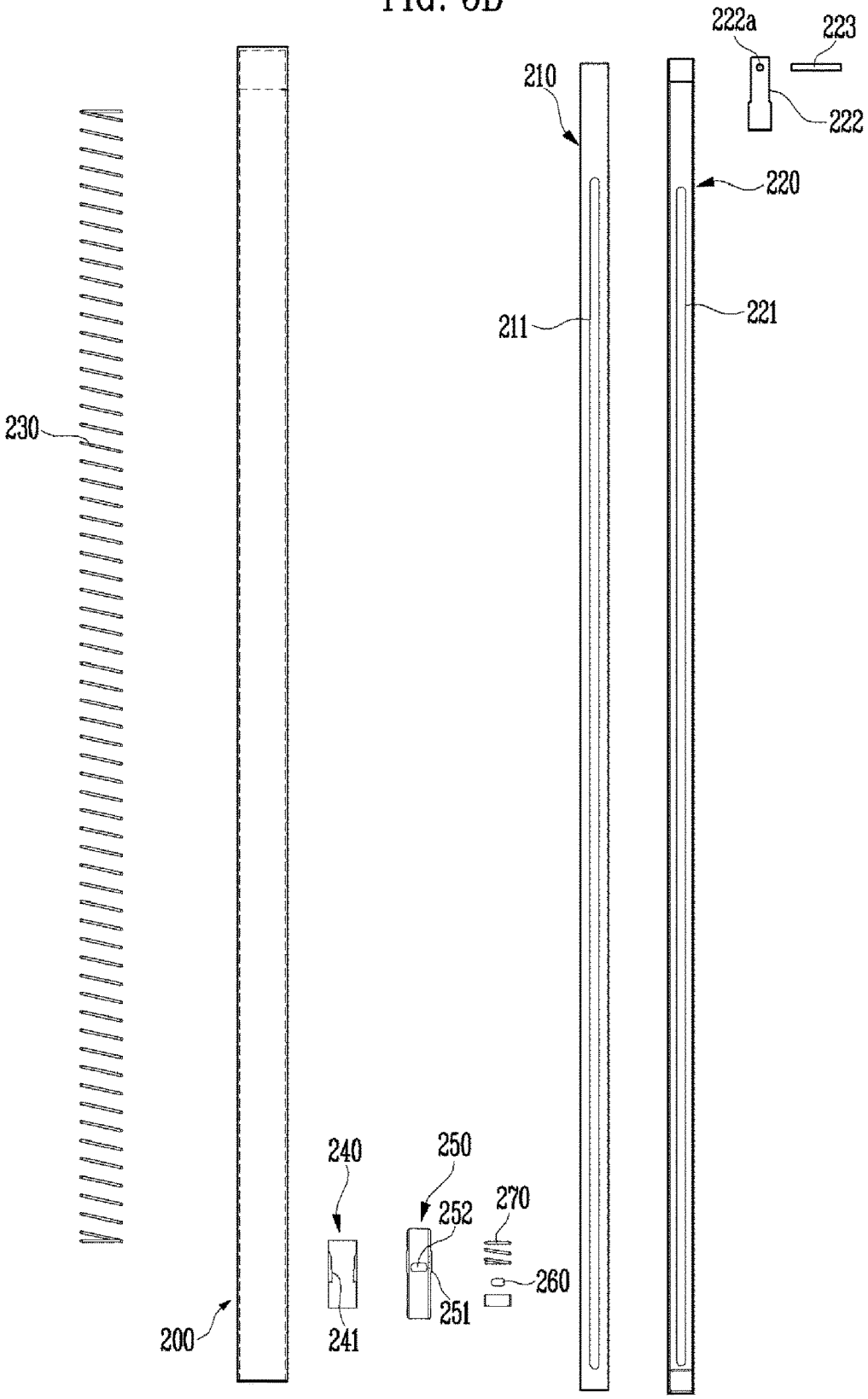
FIG. 5B is an exploded cross-sectional view of the main pole.

Referring to FIG. 5A to FIG. 5B, a main pole 200 is fastened to a lower portion of the head 100, a pipe-shaped lever shaft 210, a fixation shaft 220, and an upper extension spring 230 are installed therein, and an upper end of a fixation shaft 220 is inserted into the cap 110 to be fixedly coupled thereto.

More specifically, a lever shaft 210 is built in a main pole 200, connected with a press button 120, and is moved up and down according to a pushing or releasing operation of a press button 120, and a movement hole 211 is formed on an external circumference along a length direction. At this time, a hollow connection piece 212 is in contact with a lower portion of a pushing piece 121 inside a fastening portion 116 of a cap 110, a pusher 213 is formed at an upper end of a lever shaft 210, and a pusher 213 is contacted with a lower portion of a connection piece 212. Accordingly, when a user presses the press button 120, a pressing force is transmitted to a lever shaft 210 through a connection piece 212 and a pusher 213, and a lever shaft 210 can be lowered by a length of the press hole 121*a*.

A fixation shaft 220 is embedded in a lever shaft 210, has a movement hole 221 on an external circumference in a longitudinal direction, and a pin fixture 222 is formed at an upper end thereof, and a pin hole 222*a* is formed through a pin fixture 222. Since a pin fixture 222 is inserted into the cap 110 and fix pin 223 penetrates a pin hole 222*a* and is fixedly coupled to a press hole 121*a*, a fixation shaft 220 is always fixedly connected to a cap 110.

An upper extension spring 230 is inserted into the main pole 200 outside a lever shall 210 in a vertical direction and is expanded or contracted in response to a press or release of a press button 120, and a first extension pole 300 is drawn out from a main pole 200 or is inserted therein such that a mountain climbing stick can be easily adjusted.

An upper ball cover 240 is connected to a lower end of a lever shall 210 to move up and down together with a lever shaft 210 to apply a pressure to a fixation ball 260 or release a pressure to a fixation ball 260. For this purpose, an external circumferential surface of an upper ball cover 240 is formed as a straight pipe, and a part of an interior diameter 241 of an upper ball cover 240 is formed to downwardly decreasing the interior diameter thereof gradually.

In addition, an upper ball body 250 is connected to a lower end of the fixation shaft 220, an interior circumference is formed as a straight pipe, and a part of an external circumferential surface 251 is formed to downwardly decreasing exterior diameter thereof gradually. A fixation hole 252 is formed through an external circumferential surface 251 whose exterior diameter is gradually reduced, and a fixation ball 260 is mounted on a fixation hole 252. At this time, since a fixation hole 252 and a fixation ball 260 are formed to be a circular arc shape, a contact force of a first movement shaft 310 to a latching groove 313 can be increased. Since a fixation ball 260 is formed in a substantially banana shape and has an incision surface formed in a circular shape, it is caught in a latching groove 313 of a first movement shaft 310 to increase an contact area, and therefore, the locking force is increased, a first movement shaft 310 is smoothly moved, and a durability of a length adjustment device is also increased.

A return spring 270 is installed between an upper ball cover 240 and an upper ball body 250, and after an upper ball cover 240 moves downward due to a pressing action of the press button 120, while an upper ball cover 240 is ascending to be returned by releasing a press button 120, the return spring 20 makes its movement more smooth.

Like this, a fixation ball 260 is engaged with a latching groove 313 to fix a first movement shaft 310, depending on a depression or a release of a press button 120, a lever shaft 210 and an upper ball cover 240 move up and down, since a first movement shaft 310 of an upper ball cover 240 is locked and released through a fixation ball 260, an user can freely adjust the amount of stretching and fixing as desired.

Figure 6A:
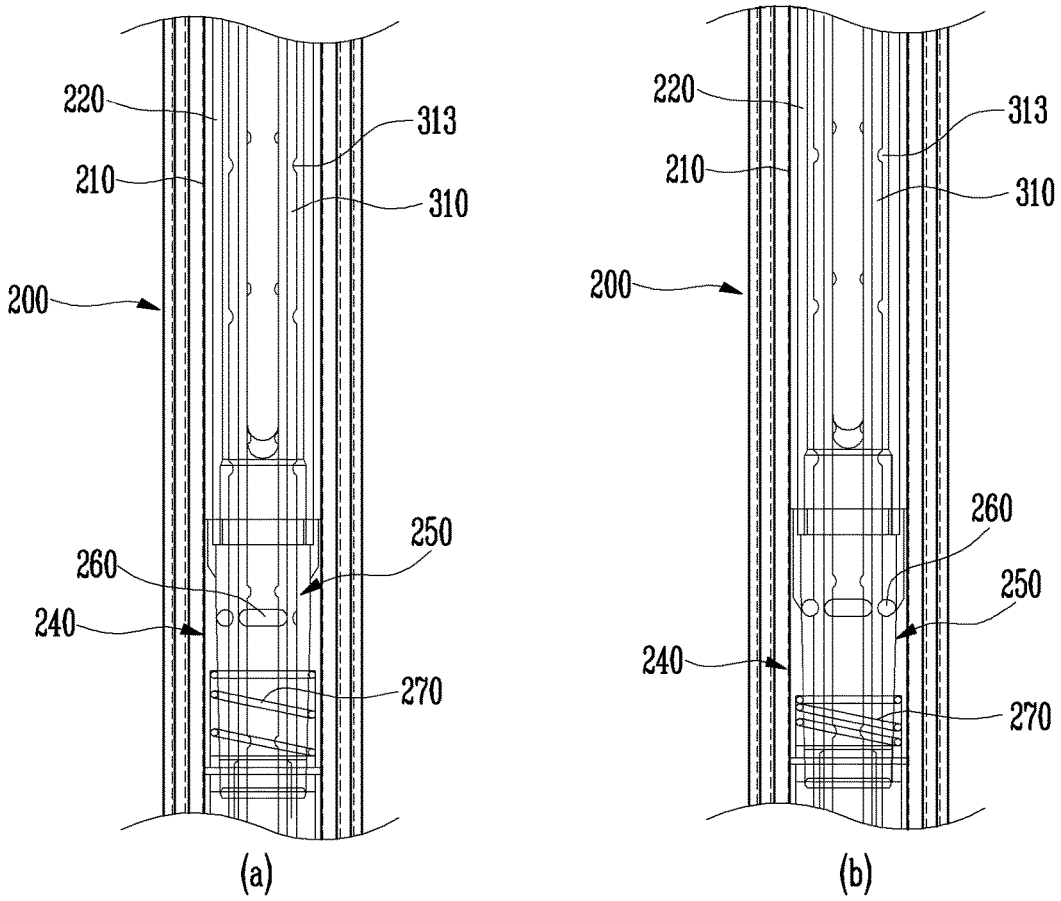
FIG. 6A is a cross-sectional view showing a locking and unlocking conditions by a fixation ball mounted on an upper ball body according to an exemplary embodiment of the present invention.

That is, as shown in (a) of FIG. 6A, in a state in which a fixation ball 260 is pressed by an upper ball cover 240 and inserted into and adhered to an arbitrary latching groove 313 formed in a first movement shaft 310, when a press button 120 is pressed as shown in (b) of FIG. 6A, an upper ball cover 240 connected to the lever shaft 210 is lowered and an upper ball cover 240 is lowered, a pressure for a fixation ball 260 is released and a fixation ball 260 moves away from a latching groove 313 and moves to an outside, and is inserted into a fixation hole 252, and therefore a length of a length adjustment device can be increased and reduced.

And, when a pressing operation of the press button 120 is stopped, the depressed press button 120 returns to an upper side, accordingly, as shown in (a) of FIG. 6A, an upper ball cover 240 rises together with the lever shaft 210, an upper ball cover 240 presses a fixation ball 260, and a fixation ball 260 is brought into close contact with the latching groove 313 such that the adjusted length is fixed.

A coupling pipe (P) formed with a thread or the like is provided at the lower end of a main pole 200, a rotation nut (N), which is tapered downward, is connected to an outside of a coupling pipe (P), when a rotation nut (N) is rotated in one direction, a first extension pole 300 pulled out by pressure is tightened, and a lower end of a main pole 200 can be fixed at an arbitrary position on a first extension pole 300.

Figure 7A:
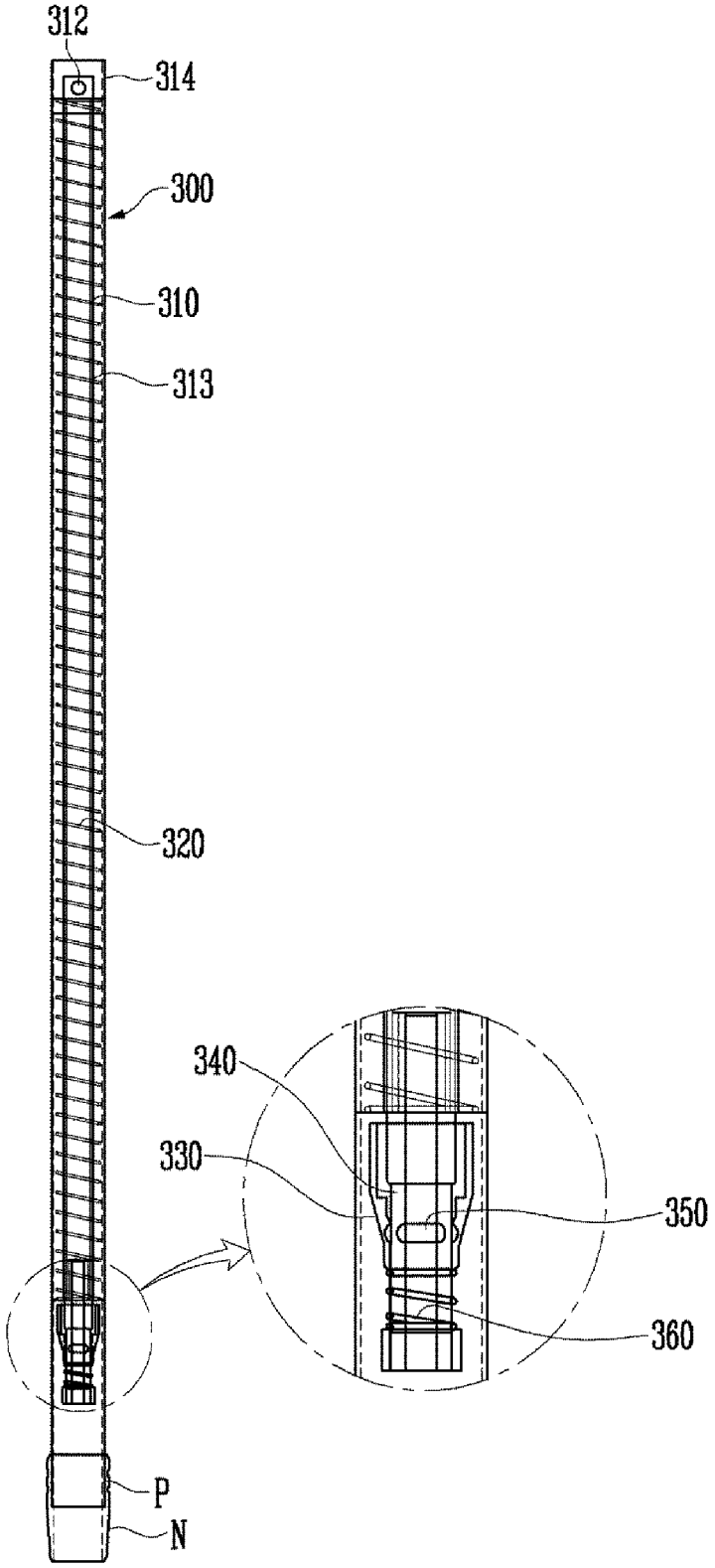
FIG. 7A is a cross-sectional view of a first extension pole according to an exemplary embodiment of the present invention.
Figure 7B:
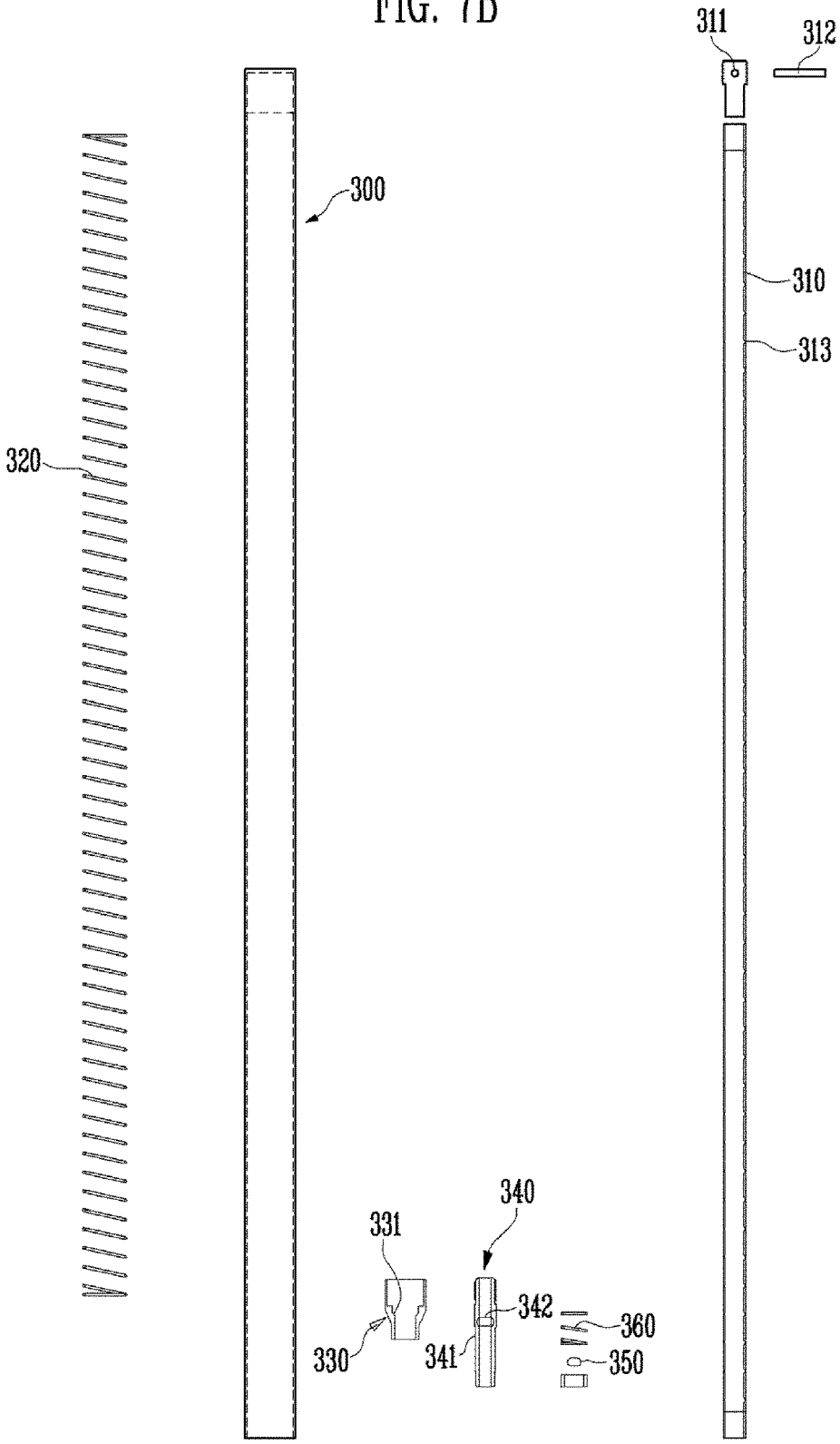
FIG. 7B is an exploded cross-sectional view of the first extension pole.

Referring to FIG. 7A and FIG. 7B, a first extension pole 300 is inserted into or drawn out of the main pole 200, and a first movement shaft 310 and a lower extension spring 320 are installed inside.

a first movement shaft 310 is fixedly coupled to a first extension pole 300 through an upper block 314 and is prevented from coming out of the first extension pole 300, and they move up and down together to be inserted or withdraw out of the main pole 200.

In this first movement shaft 310, A plurality of latching grooves 313 are formed to be spaced apart from each other along a length direction on an external circumference, and a fixation ball 260 mounted on a fixation hole 252 of an upper ball body 250 is inserted into the latching groove 313 to fix a first movement shaft 310 such that a length of a length adjustment device is not stretched or reduced.

Further, a first movement shaft 310 has a pin hole 311 formed at its upper end, a pin hole 311 is coupled with a movement pin 312, a movement pin 312 is assembled to pass through a movement hole 211 of a lever shaft 210 and a movement hole 221 of a fixation shaft 220, and therefore, a first movement shaft 310 can be moved by a length of the slit-shaped movement holes 211 and 221.

A lower extension spring 320 is vertically inserted on an outer side of a first movement shaft 310 inside a first extension pole 300 and is lengthened or reduced according to a pushing or releasing operation of a push button 120, a released second extension pole 400 can be smoothly inserted into or drawn out from a first extensible pole 300, and a length adjustment device is easily changed.

A lower ball body 340 is connected with a lower end portion of a first movement shaft 310, an interior circumference is formed as a straight pipe, and some external circumferential surface 341 is formed in such a manner that an exterior diameter gradually decreases downward. And, a fixation hole 342 is formed through an external circumferential surface 341 having an exterior diameter gradually reduced and formed, and a fixation ball 350 is mounted on a fixation hole 342. At this time, a fixation hole 342 and a fixation ball 350 are formed in a circular arc shape so that an adhesion force to a latching groove 411 of a second movement shaft 410 can be increased. Since a fixation ball 350 is formed in a substantially banana shape and has an incision surface formed in a circular shape, it is caught in a latching groove 411 of a second movement shaft 410 to increase an contact area, and therefore, the locking force is increased, a second movement shaft 410 is smoothly moved, and a durability of a length adjustment device is also increased.

A lower ball cover 330 is formed in contact with the outer side of the lower ball body 340, a part of an interior circumference 331 are formed so that an interior diameter gradually decreases downward, and is lifted or lowered by an upper ball cover 240 to press or release a fixation ball 350.

A return spring 360 is interposed between a lower ball cover 330 and a lower ball body 340, and after a lower ball cover 330 moves downward by a pressing action of a press button 120, when returns to an upper side by a release of a press button 120, a return spring 360 makes it more smoothly and flexibly.

Like this, a fixed ball 350 is caught by a latching groove 411 to fix a second movement shaft 410, a lower ball cover 330 that is pushed by the upper ball cover 240 or is returned by a return spring 360 according to the depression or release of the push button 120 is lifted or lowered to lock or unlock a lower ball cover 330 against a second movement shaft 410 through a fixation ball 350, and therefore an user can freely change and fix a length as desired.

Figure 6B:
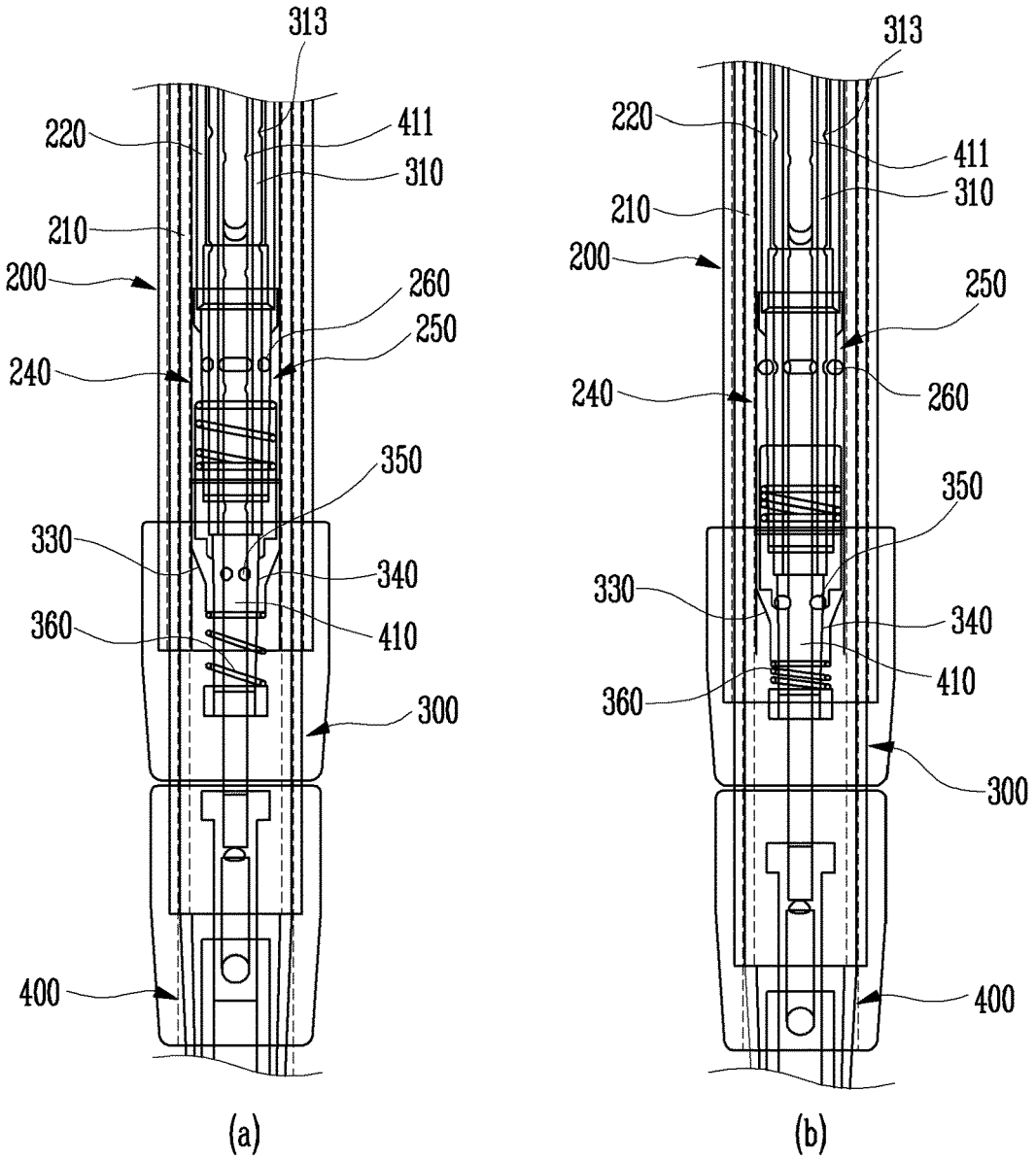
FIG. 6B is a cross-sectional view showing an locking and unlocking conditions by a fixation ball mounted on a lower ball body according to an exemplary embodiment of the present invention.

That is, as shown in (a) of FIG. 6B, in a condition that a first extension pole 300 and a second extension pole 400 are both folded and inserted into the main pole 200, a fixation ball 350 is pressed by a lower ball cover 330 and inserted in an arbitrary latching groove 411 formed in a second movement shaft 410, as shown in (b) of FIG. 6B, when a press button 120 is pressed, a lever shaft 210 and the upper ball cover 240 are lowered, as the upper ball cover 240 descends, a lower ball cover 330 is lowered to release a pressure for a fixation ball 350 so that a fixation ball 350 moves away from a latching groove 411 and moves to an outside, and is inserted into an fixation hole 342, and therefore a length of a second extension pole 400 can be increased or decreased with an aid of the lower extension spring 230.

In this state, a distance that a lower ball cover 330 is pushed is designed to be shorter than a distance that an upper ball cover 240 is pushed so that a lock state by a lower ball cover 330 is released earlier than a lock state by an upper ball cover 240, a second extension pole 400 is drawn out first to adjust a length, then a first extension pole 300 is drawn out to adjust a length, and it is desirable to allow fine length adjustment for both a first and a second extension poles.

And, when a depression of a press button 120 is stopped, a depressed press button 120 returns to an upper side, as shown in (a) of FIG. 6B, an upper ball cover 240 is raised and a lower ball cover 330 is again raised by a return spring 360, a lower ball cover 330 presses a fixation ball 350, and a fixation ball 350 is fixed to a latching groove 411 so that the adjusted length is fixed.

A coupling pipe (P) formed with a thread or the like is provided at the lower end of a first extension pole 300, a rotation nut (N), which is tapered downward, is connected to an outside of a coupling pipe (P), when a rotation nut (N) is rotated in one direction, a second extension pole 400 pulled out by pressure is tightened, and a lower end of a first extension pole 300 can be fixed at an arbitrary position on a second extension pole 400.

Figure 8A:
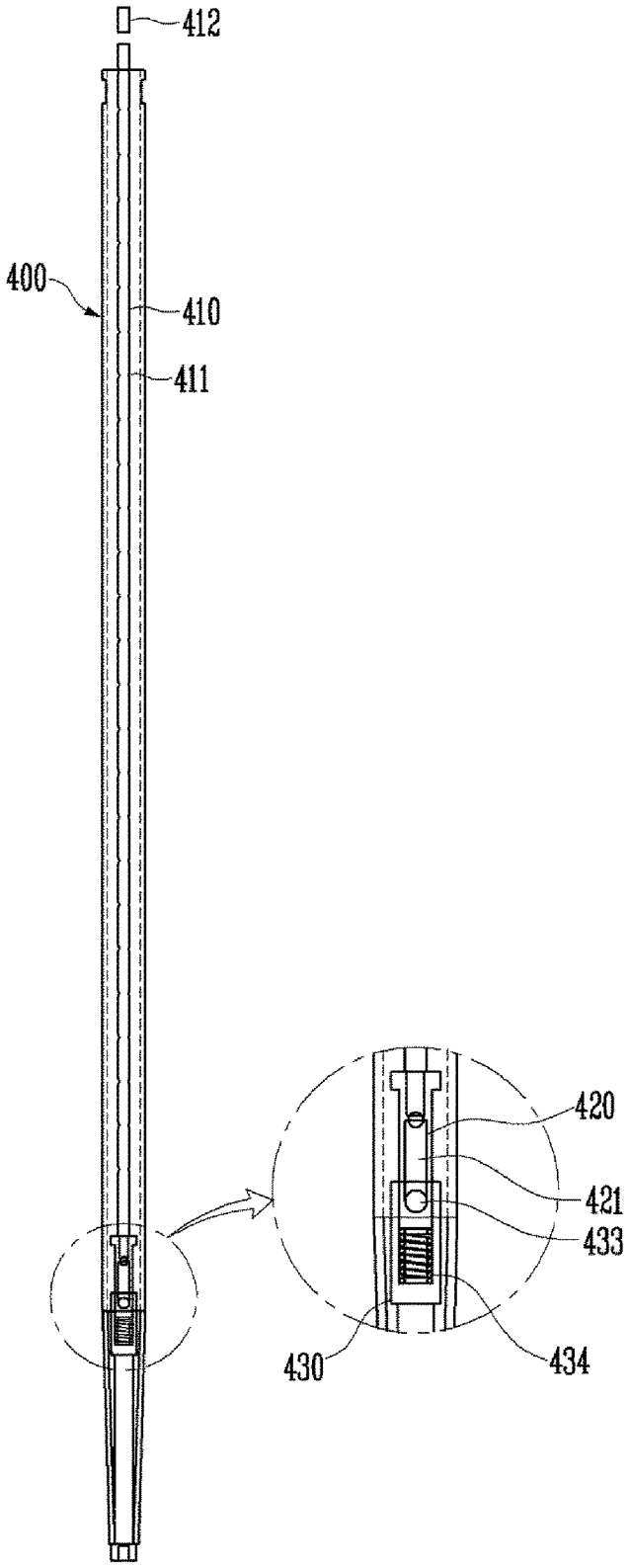
FIG. 8A is a cross-sectional view of a second extension pole according to an exemplary embodiment of the present invention.
Figure 8B:
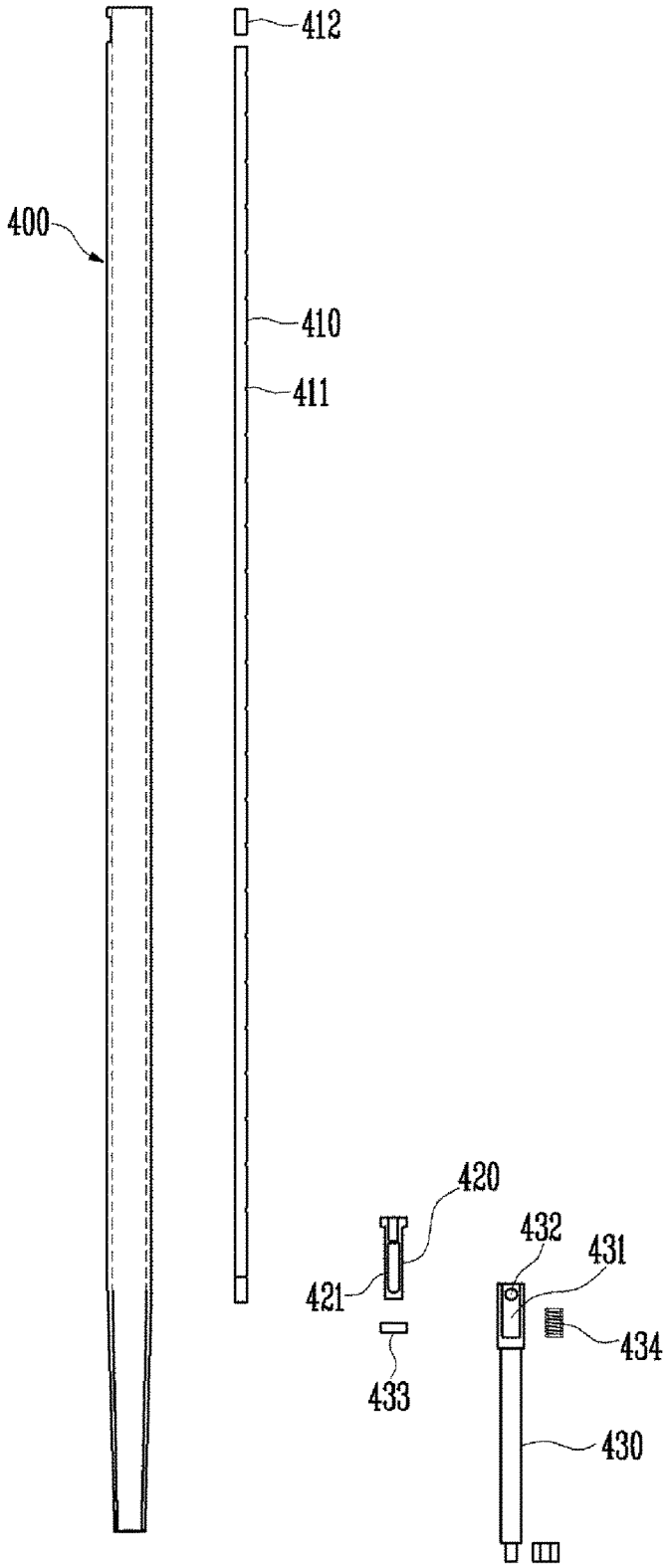
FIG. 8B is an exploded cross-sectional view of a second extension pole.
Figure 9A:
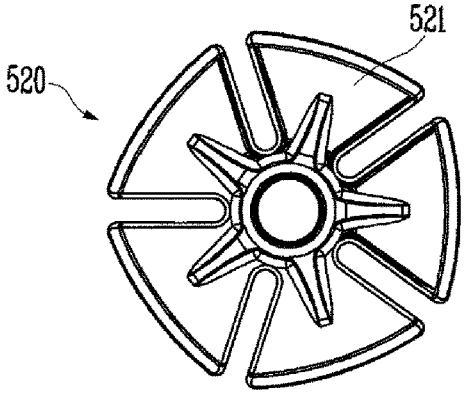
FIG. 9A to 9D are a drawing illustrating a configuration of a support portion according to an exemplary embodiment of the present invention.
Figure 9B:
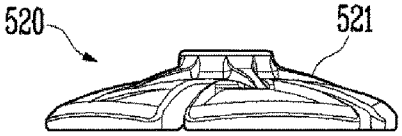
Figure 9C:
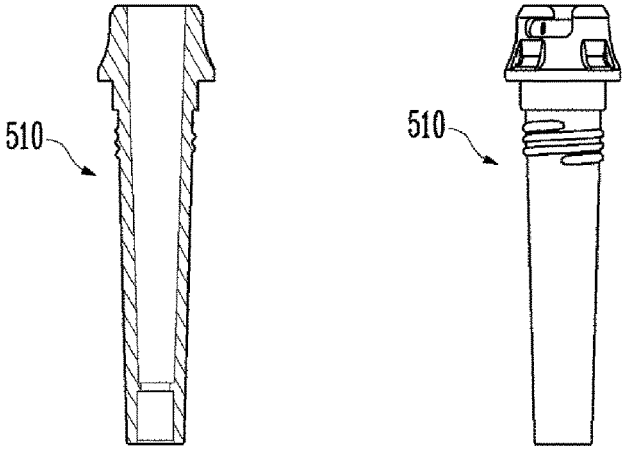
Figure 9D:
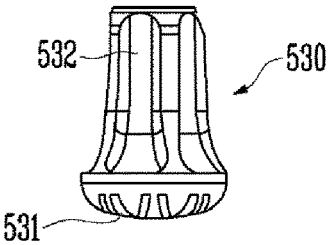

Referring to FIG. 8A and FIG. 8B, a second extension pole 400 is inserted into or drawn out of a first extension pole 300, and a second movement shaft 410 is installed therein.

A second movement shaft 410 is fixedly coupled to a second extension pole 400 to be prevented from escaping, and moves up and down together to be inserted into or drawn out of a first extension pole 300.

A plurality of latching grooves 411 are formed to be spaced apart from each other along a length direction on the external circumference of a second movement shaft 410, a fixation ball 350 mounted on a fixation hole 342 of a lower ball body 340 is inserted into a latching groove 411 and a second movement shaft 410 is fixed such that a length of a length adjustment device is fixed not to be stretched or reduced.

A stopper 412 having a diameter greater than that of a body is formed at an upper end of a second movement shaft 410 to prevent a second extension pole 400 from being separated even after a second extension pole 400 is drawn out.

A support holder 420 is provided at a lower side of a second movement shaft 410, a slit-shaped lower end hole 421 is formed in a support holder 420, and a support holder 420 is inserted into an insertion hole 431 of an upper portion of an inside of a support shaft 430. A pin hole 432 is formed through a support shaft 430, an anti-shock spring 434 is inserted into the insertion hole 431, a support holder 420 is to inserted into an insertion hole 431 and is buffer-supported on an anti-shock spring 434, a fixation pin 433 passes through a pin hole 432 and is fixedly coupled to a lower end hole 421, this results in an action of an anti-shock spring 434 along a lower end hole 421 having a form of a slit such that it has the effect of soft and flexible action on the ground when adjusting the length.

Further, a support portion 500 is coupled to a lower end portion of a second extension pole 400. Referring to FIG. 9, in a support portion 500, a lower end of a second extension pole 400 is inserted into a support pipe 510 to be fixed thereto, a support pipe 510 is tapered downward, a support wing 520 that plurality of support blades 521 are formed in a radial direction to be spaced apart from each other is disposed on an upper end of a support pipe 510 to prevent stones or soil from being splashed on an user, and a lower portion of a support pipe 510 is inserted into a support pad 530 contacting a ground surface. A support pad 530 has a plurality of support protrusions 531 formed on a lower surface thereof to increase a contact force with a ground surface and a plurality of support grooves 532 formed on a sides thereof reduces the weight.

Hereinafter, referring to drawings, an operation of a length adjustment device according to a present invention will be detailed.

Figure 10A:
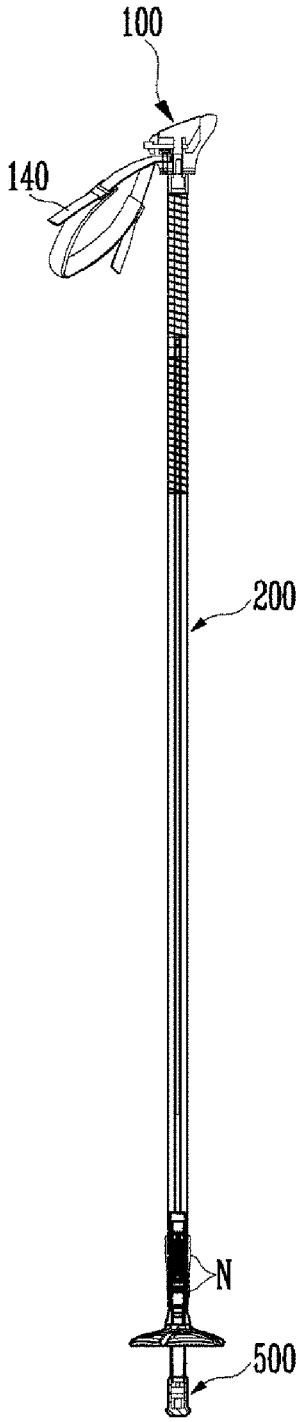
FIG. 10A is a cross-sectional view when a length adjustment device is folded according to the present invention.
Figure 10B:
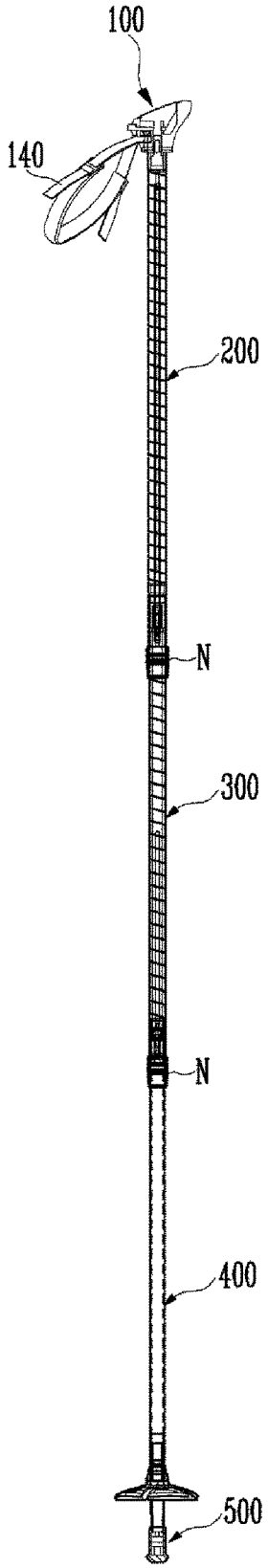
FIG. 10B is a cross-sectional view when a length adjustment device is extended according to the present invention.

For example, as shown in FIG. 10A, in a condition that the length adjustment device folded and stored, when an operation piece 132 of a lock button 130 is rotated in an OPEN direction, a rotation of a restriction piece 133 of a lock button 130 causes a lock piece 122 to be unlocked. When a rotation nut (N) is rotated to an open state and a press button 120 is pressed, a lever shaft 210 and an upper ball cover 240 descend, a lower ball cover 330 pushed down by a lowering of an upper ball cover 240 is released to the pressure for the fixation ball 350, a fixation ball 350 moves away from a latching groove 411 and moves to an outside and is inserted into a fixation hole 342, and therefore a second movement shaft 410 can move freely and with an aid of a lower extension spring 320, a length of the second extension pole 400 can be adjusted as desired by the user.

And, an upper ball cover 240 is pushed down and a pressure against a fixation ball 260 is released, a fixation ball 260 moves outward from a fixation hole 252 to unlock a locking ball 260 and a latching groove 313, a first movement shaft 310 can move freely, at this time, since an upper extension spring 230 is stretched together, a first extension pole 300 may draw out from a main pole 200 and the length may be extended.

If it is determined that a length of a length adjustment device is adjusted in a state that an user can easily use, an user releases a force pressing a press button 120 so that a lever shaft 210 and an upper ball cover 240 are raised while a press button 120 is returned to an upper position, an upper ball cover 240 is pressed against a fixation ball 260 so that a fixation ball 260 is inserted and fixed into a latching groove 313 of a first movement shaft 310, in this state, even if a first extension pole 300 is pulled or applied, it is not stretched any further.

Of course, a lower ball cover 330 rises to press a lower ball cover 330 against a fixation ball 350 so that a fixation ball 350 is inserted into a latching groove 411 of a second movement shaft 410 to be fixed thereto.

In this state, when a rotation nut (N) is rotated, a rotation nut (N) moves upward, and a rotation nut (N) fastens and fixes a first extension pole 300 and a second extension pole 400 drawn out.

Then, when an operation piece 132 of a lock button 130 is rotated in a LOCK direction, a restriction piece 133 of a lock button 130 is rotated by a rotation, a lock piece 122 is fixed, and a press button 120 is locked.

Meanwhile, so as to shorten a length of the climbing stick and fold it again, an user first rotates an operation piece 132 of a lock button 130 in an OPEN direction, an opening hole 133*a* of a lock button 130 is positioned directly under the lock piece 122, and a press button 120 is kept open.

And, a rotation nut (N) is rotated to remove a pressure of the rotation nut (N), when the press button 120 is pressed, with the above-described operation, a first movement shaft 310 and the second movement shaft 410 are unlocked, an upper extension spring 230 and an lower extension spring 320 were compressed by pressing a lower end of a length adjustment device, a first extension pole 300 and a second extension pole 400 are drawn into a main pole 200, a pressing action of a press button 120 is released, a press button 120 is returned to an upper position to be locked again, and a rotation nut (N) is rotated to be fixed a coupling pipe (P).

In addition, an anti-shock spring 434 functions when a length adjustment device with an adjusted length is used against to the ground, and a length adjustment device acts on the ground smoothly and flexibly by a force of an anti-shock spring 434.

In a length adjustment device according to a present invention, length stretching and fixing can be freely adjusted as desired with a press button, a ball cover and a ball body are on an upper and lower sides and a circular arc shaped fixation ball is interposed between them, a detailed length adjustment for a first and a second extension poles is possible and the locking force is increased, an anti-shock spring realizes a flexible effect against the ground when controlling the length, a length of the entire device can be easily changed by using a force of an upper and a lower extension springs by an operating of only one press button, It is convenient because it can be easily fixed with a small force after stretching the device as much as desired, the length adjustment works is smoothly performed, adjustment portions are formed on both straps so that length adjustment becomes easy regardless of the hand holding the device, and It can be quickly operated and responded in various usage environments, and has excellent usability and convenience.

Figure 11A:
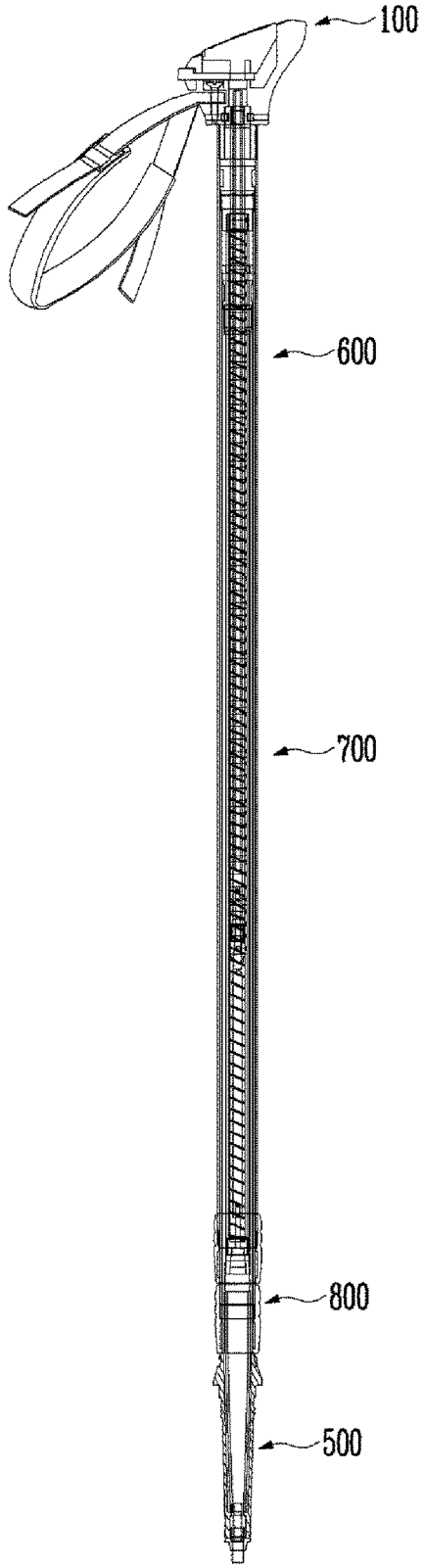
FIG. 11A is a cross-sectional view when folding a length adjustment device according to another exemplary embodiment of the present invention.
Figure 11B:
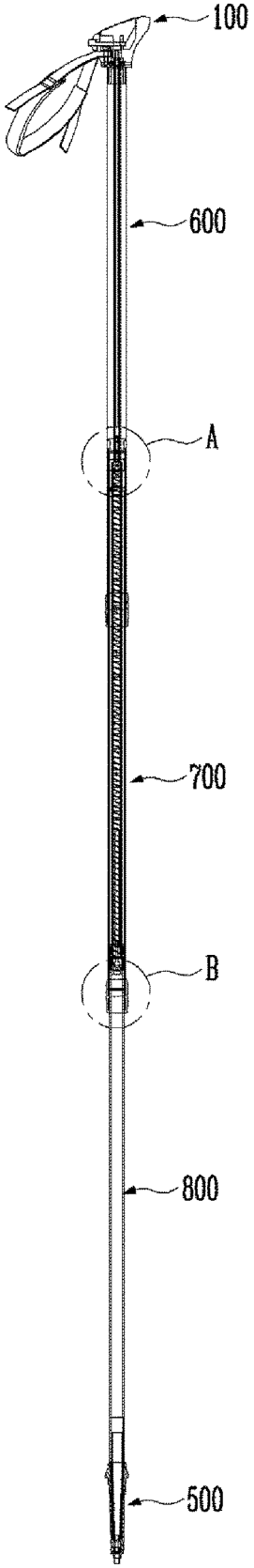
FIG. 11B is a cross-sectional view when extending a length adjustment device according to another exemplary embodiment of the present invention.
Figure 12:
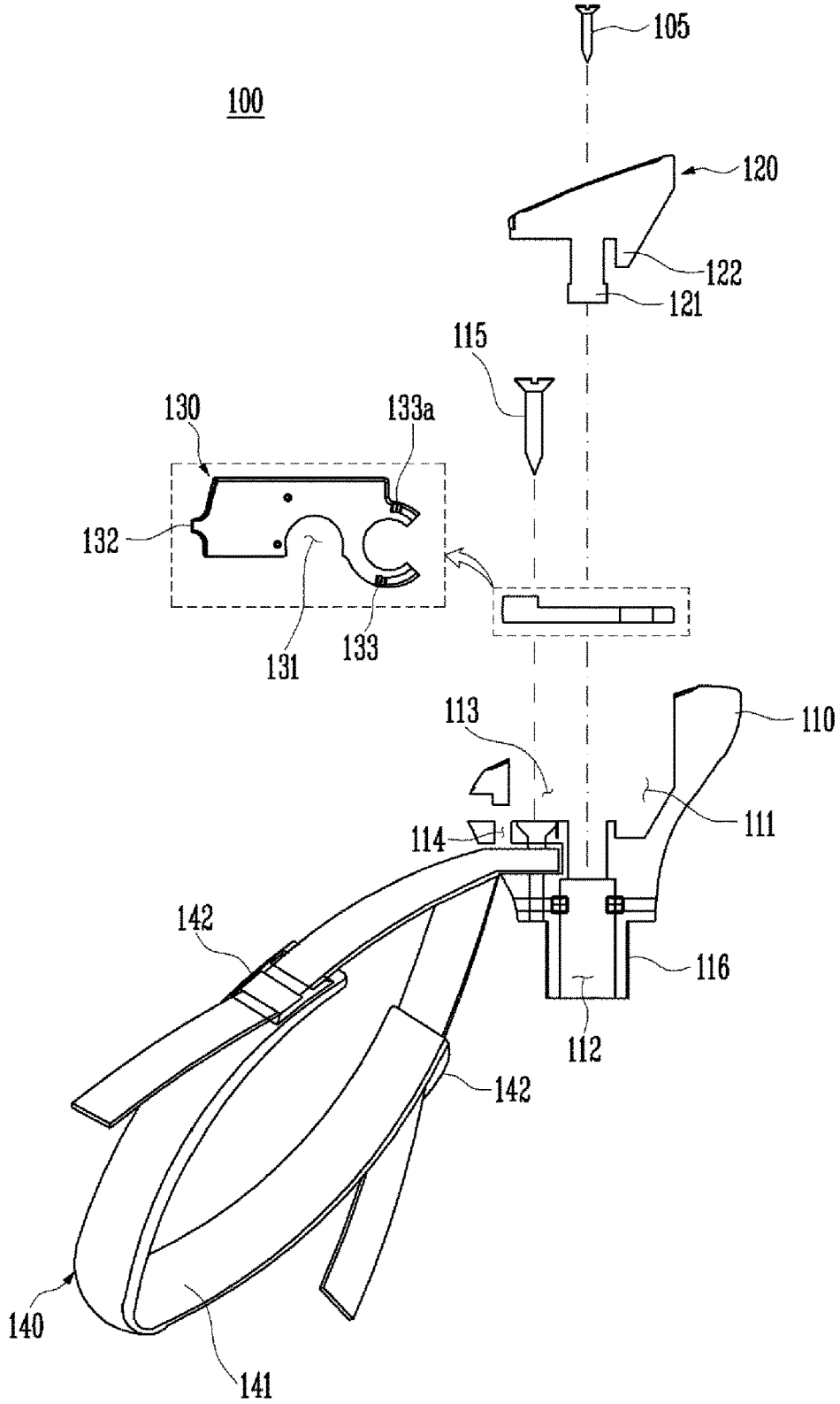
FIG. 12 is an exploded cross-sectional view of the head according to another exemplary embodiment of the present invention.
Figure 13A:
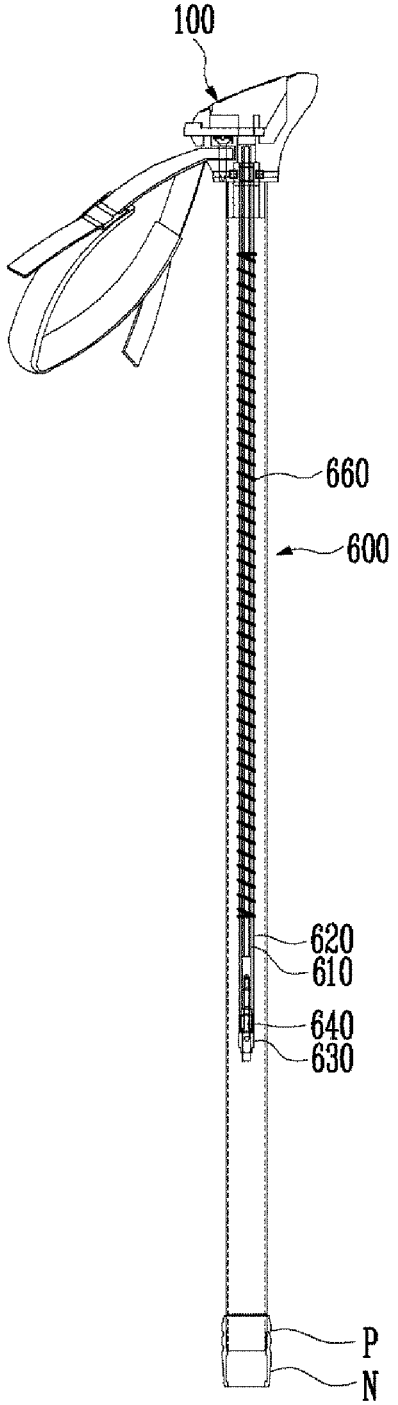
FIG. 13A is a cross-sectional view of a main pole according to another exemplary embodiment of the present invention.
Figure 13B:
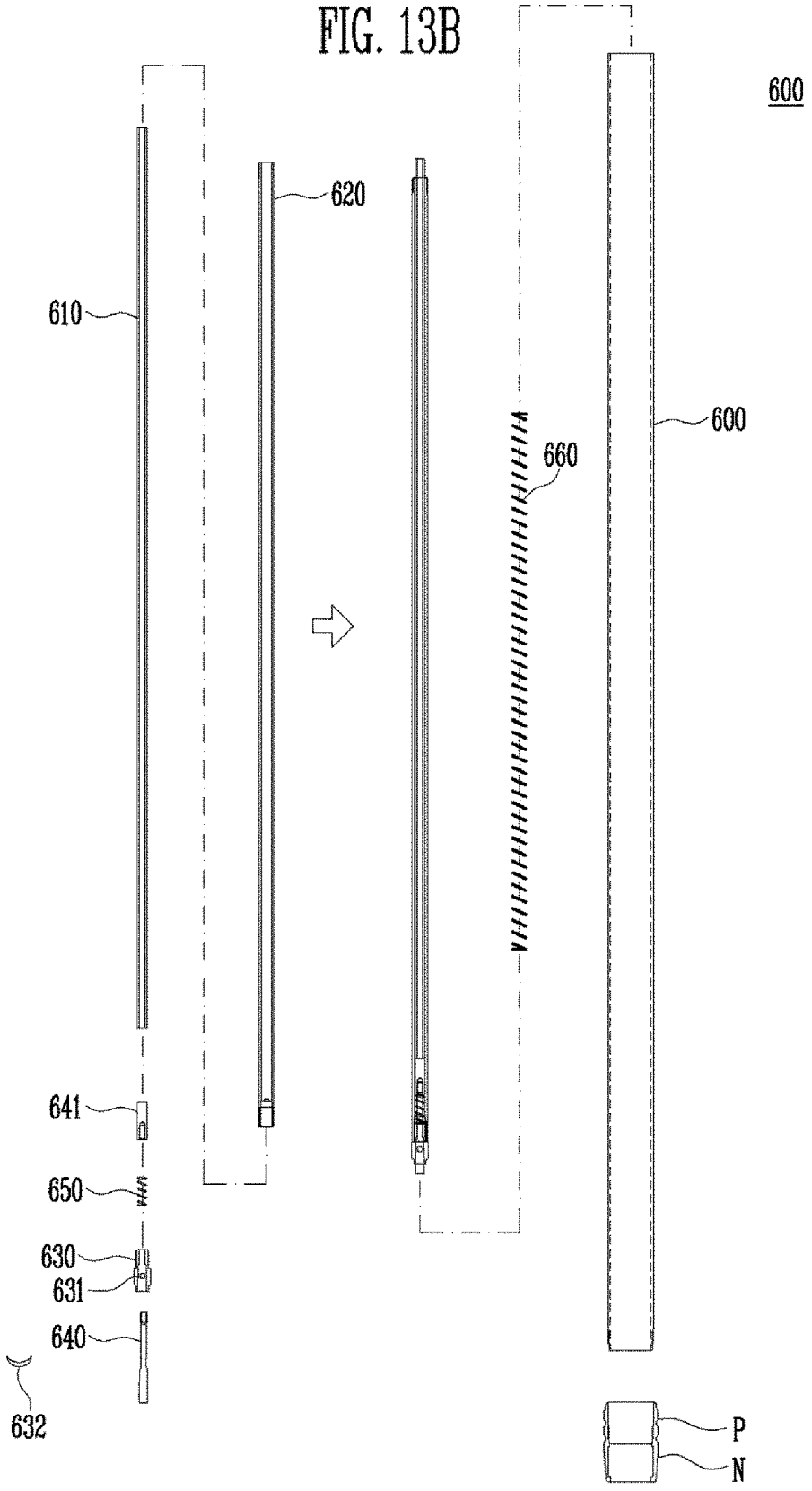
FIG. 13B is an exploded cross-sectional view of a main pole according to another exemplary embodiment of the present invention.
Figure 14A:
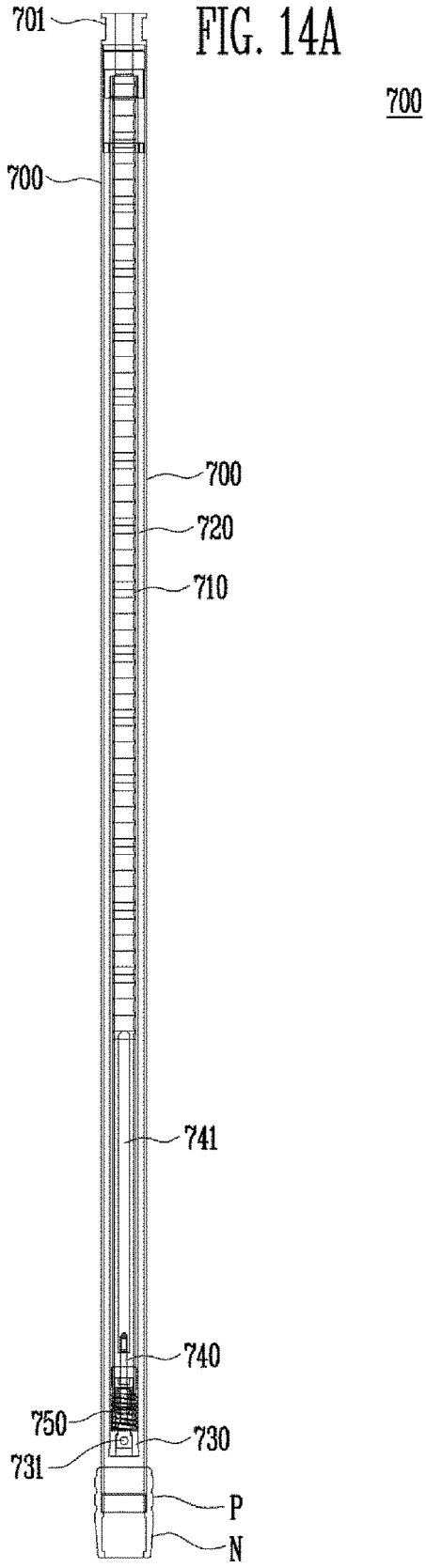
FIG. 14A is a cross-sectional view of a first extension pole according to another exemplary embodiment of the present invention.
Figure 14B:
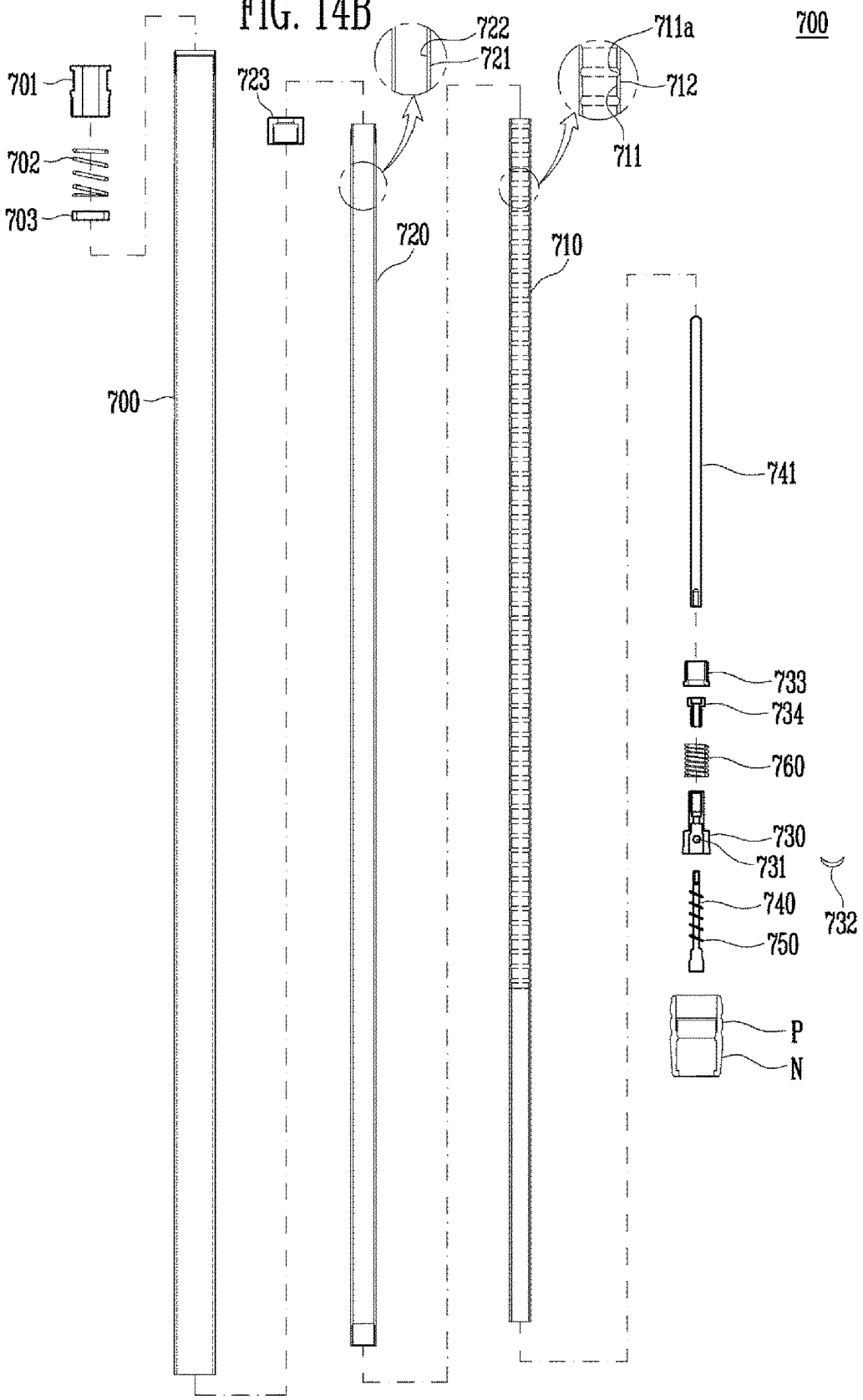
FIG. 14B is an exploded cross-sectional view of a first extension pole according to another exemplary embodiment of the present invention.
Figure 15A:
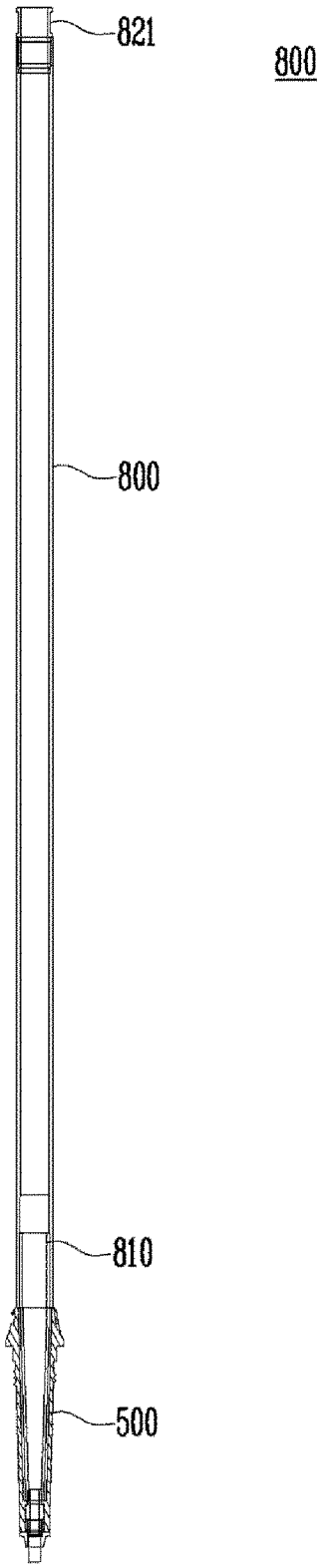
FIG. 15A is a cross-sectional view of a second extension pole according to another exemplary embodiment of the present invention.
Figure 15B:
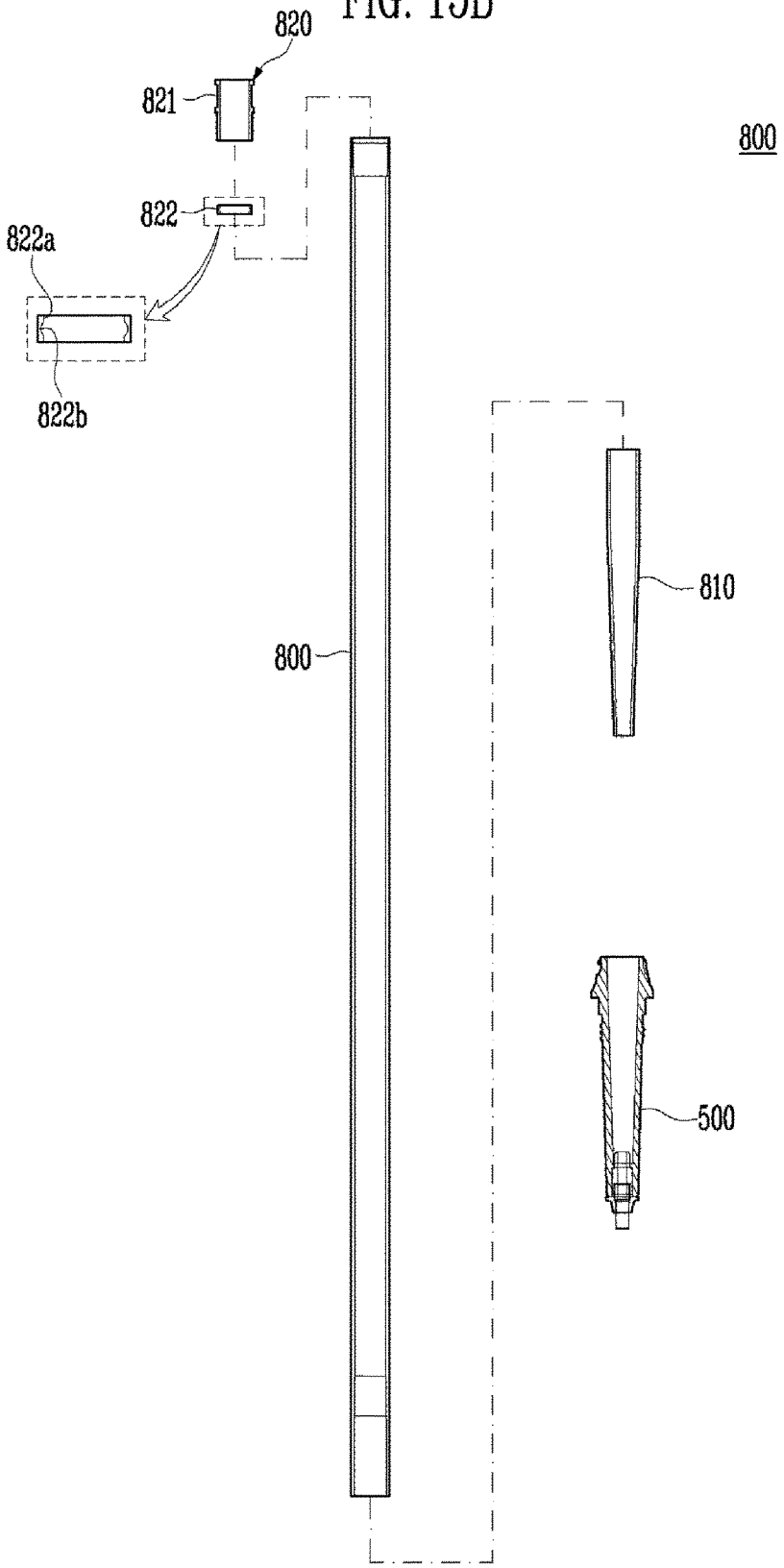
FIG. 15B is an exploded cross-sectional view of a second extension pole according to another exemplary embodiment of the present invention.
Figure 16:
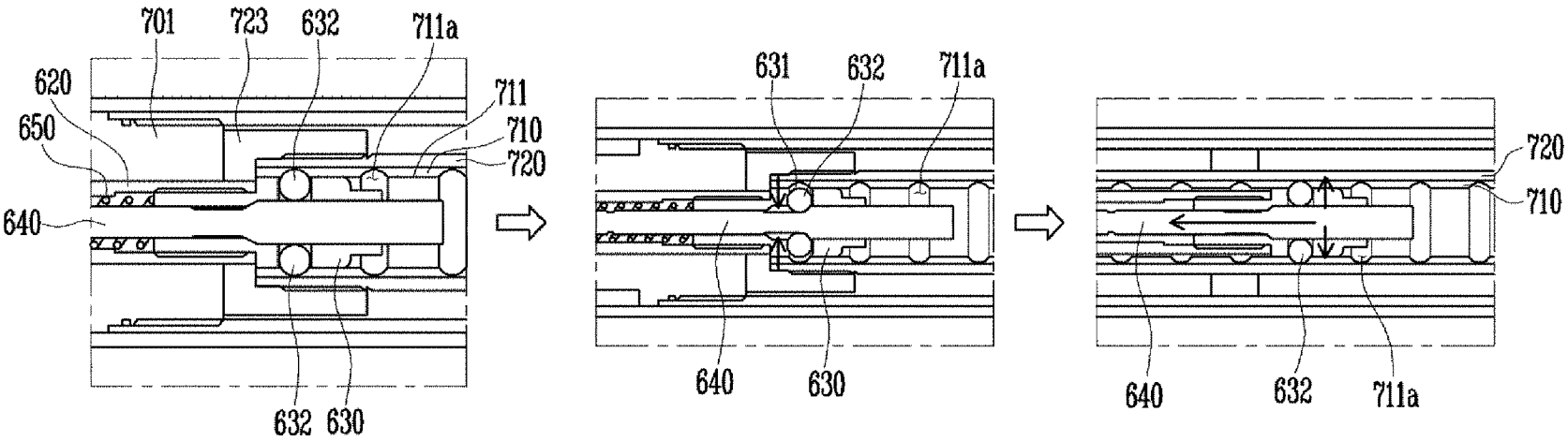
FIG. 16 is a view of adjusting the length of a first extension pole according to another exemplary embodiment of the present invention.
Figure 17:
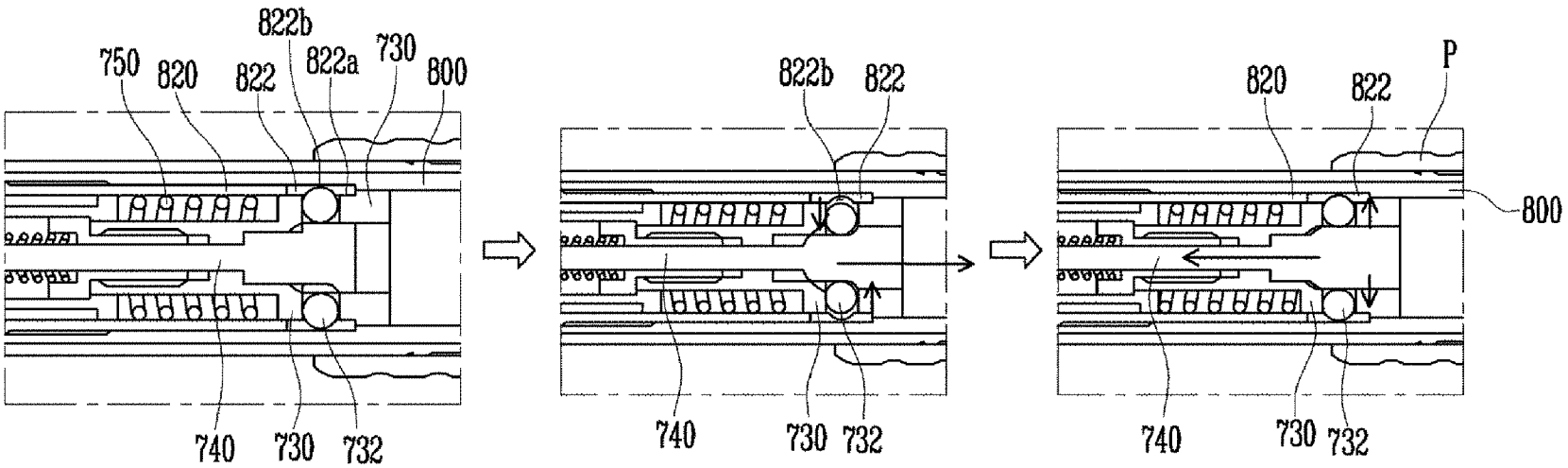
FIG. 17 is a view of adjusting the length of a second extension pole according to another exemplary embodiment of the present invention.

FIG. 11A is a cross-sectional view when folding a length adjustment device according to another exemplary embodiment of the present invention, and FIG. 11B is a cross-sectional view when extending a length adjustment device according to another exemplary embodiment of the present invention, FIG. 12 is an exploded cross-sectional view of the head according to another exemplary embodiment of the present invention, FIG. 13A is a cross-sectional view of a main pole according to another exemplary embodiment of the present invention, and FIG. 13B is an exploded cross-sectional view of a main pole according to another exemplary embodiment of the present invention, FIG. 14A is a cross-sectional view of a first extension pole according to another exemplary embodiment of the present invention, and FIG. 14B is an exploded cross-sectional view of a first extension pole according to another exemplary embodiment of the present invention, FIG. 15A is a cross-sectional view of a second extension pole according to another exemplary embodiment of the present invention, and FIG. 15B is an exploded cross-sectional view of a second extension pole according to another exemplary embodiment of the present invention, FIG. 16 is a view of adjusting the length of a first extension pole according to another exemplary embodiment of the present invention, and FIG. 17 is a view of adjusting the length of a second extension pole according to another exemplary embodiment of the present invention.

As shown in FIG. 11 to FIG. 17, a length adjustment device according to another exemplary embodiment of the present invention includes a head 100, a main pole 600, a first extension pole 700, a second extension pole 800, and a support portion 500.

In another exemplary embodiment of a length adjustment device according to a present invention, for convenience, the same reference numerals are used such as a main pole 200, a first extension pole 300, a second extension pole 400, and so on in a length adjustment device according to a present invention shown in FIG. 2 to FIG. 10, but they do not necessarily refer to the same configuration.

Hereinafter, since the configuration of the support portion 500 is identical to a length adjustment device according to a present invention shown in FIG. 2 to FIG. 10, only a head 100, a main pole 600, a first extension pole 700, and a second extension pole 800 will be described in detail.

Referring to FIG. 12, a head 100 includes a cap 110 forming an outside, a press button 120 that includes a pushing piece 121 that is mounted on a cap 110 to be extended in a lower side and a lock piece 122 that is extended in a lower side and is configured to be parallel to a pushing piece 121, and a lock button 130 which is detachably mounted on an external circumferential surface of a pushing piece 121 to perform a lock operation or an open operation by lowering or fixing a lock piece 122.

A cap 110 includes an upper mounting groove 111 in which a press button 120 is installed, a lower mounting groove 112 in which an upper end of the fixation shaft 620 is inserted and fixed, a fastening portion 116 that is provided in a lower portion to fasten a main pole 600, a drawing hole 113 through which an one end portion of a lock button 130 is drawn out, and a webbing groove 114 to which the webbing strap 140 is coupled.

Here, a lower mounting groove 112 may be formed with holes (not shown) at any positions on both sides thereof to fix the stationary shaft 620 with fixing means such as a not shown bolt, and an adjustment portion 142 for adjusting a length may be formed on a strap 141 on both sides of a webbing strap 140 so that a length can be easily adjusted regardless of a position of the hand.

The unexplained numbers except the configuration of the said head 100 are the same as the numbers of the head 100 that is explained in a length adjustment device according to a present invention shown FIG. 2 to FIG. 10.

Referring to FIG. 13A and FIG. 13B, a main pole 600 includes a fixation shaft 620 that is engaged with a cap 110 and an upper end is inserted into a cap 110 to be fixed thereto, a lever shaft 610 that is built in a fixation shaft 620, an upper end portion is connected with a press button 120 to be lifted or lowered in accordance with a press or a release of a press button 120, an upper ball cover 630 that is connected with a lower end portion of a fixation shaft 620 and a first fixation ball 632 is mounted on a first fixation hole 631 that penetrates an external circumferential surface, a first ball lever portion 640 that is connected with a lower end portion of a lever shaft 620 to be lifted or lowered together and at least a part of an external circumferential surface is formed to be recessed such that a first fixation ball 632 is inserted into or drawn out of an upper ball cover 630, an upper return spring 650 that is disposed in the fixation shaft 620 and is disposed between a first ball lever portion 640 and an upper ball cover 630 to return a first ball lever portion 640, and a first extension pole return spring 660 that is disposed between a main pole 600 and a lever shaft 620 to house a lever shaft 62 and generates a force for pushing or pulling a first extension pole 700.

Here, a first fixation groove 631 and a first fixation ball 632 can have a circular arc shape, and a first lever cap 641 can be engaged with an upper end of a first ball lever portion 640. A first lever cap 641 is fixedly connected with a lower end portion of a lever shaft 610 to be able to ascend or descend together.

A main pole 600 is provided with a coupling pipe (P) at its lower end and a rotation nut (N) tapered downward is connected to an outside of the coupling pipe (P), and when a rotation nut (N) is rotated, a first extension pole 700 drawn out can be fastened and fixed.

The unexplained configuration except for the configuration of the described main pole 600 is identical to the configuration described in the main pole 200 described in the present invention shown in FIG. 2 to FIG. 10.

Referring to FIG. 14A and FIG. 14B, a first extension pole 700 includes a first movement shaft 710 that is inserted into or out of a main pole 600 and moves between a main pole 600 and a fixation shaft 620, a plurality of first latching grooves 711*a* are formed on an interior circumference 711 along a length direction, and a movement is locked or unlocked depending on whether a first fixation ball 632 mounted on an upper ball cover 630 is latched or not, a lower ball cover 730 that is attached to a lower end of a first movement shaft 710 and is fitted with a second fixation ball 732 in a second fixation hole 731 formed in a circular arc shape on an external circumferential surface, a second ball lever portion 740 that is installed under a latching groove 711*a* inside a first movement shaft 710 and moves up and down together with a first ball lever portion 640 so that a second fixation ball 732 is inserted into or drawn out of a lower ball cover 730, and at least a portion of an external circumferential surface is recessed, and a lower return spring 750 that is disposed between a lower ball cover 730 and a second ball lever portion 740 to return a second ball lever portion 740.

Here, an external circumferential surface 712 of a first movement shaft 710 is formed as a straight line, and a first movement shaft 710 may be formed by a combination of a plurality of shafts.

Separated lines (not shown) may be respectively formed in a plurality of first latching grooves 711*a* or in a straight portion of an interior circumference other than a plurality of first latching grooves 711*a*.

When a first latching groove 711*a* is formed on an external circumferential surface, it is difficult to manufacture a first latching groove 711*a*. Thus, in an exemplary embodiment of the present invention, a plurality of segmented shafts are produced, and the segmented shafts are combined to form a first movement shaft 710, and thereby mass production is possible and manufacturing costs are reduced.

In addition, a second ball lever portion 740 can be connected to a second lever cap 741 through an inside of a lower ball cover 730, a ball cover second cap 734, and a ball cover first cap 733 in sequence.

A first extension pole 700 may further include a cover shaft 720 in which an interior circumference 721 and an external circumferential surface 722 are formed in a straight line and an interior circumference 721 is abutted against an external circumferential surface 712 of a first movement shaft 710.

A cover shaft 720 can couple a first movement shaft 710 to an interior circumference 721 and can provided with an upper limit portion 732 to limit an upward movement of a first movement shaft 710.

Also, a first extension pole 700 is provided with a first connection portion 701, and a first anti-shock spring 702 and a first anti-shock support ring 703 can be provided at a lower end of a first connection portion 701.

That is, a first extension pole 700 includes a first anti shock spring 702 and a first anti shock support ring 703, when a length adjustment device with a length adjusted is used on a ground, a first anti-shock spring 702 functions so that a length adjustment device acts smoothly and flexibly on a ground by a force of a first anti-shock spring 702, and this prevents an impact between a first extension pole 700 and a main pole 600.

Also, a first extension pole 700 can further includes a second anti shock spring 760 that is disposed in a first movement shaft 710 and is disposed between a second ball lever portion 740 and a lower ball cover 730 to prevent an impact between a first extension pole 700 and a second extension pole 800.

In this condition, a second anti shock spring 760 is disposed between a ball cover second cap 734 and a lower ball cover 730 to house a second ball lever portion 740 therein.

A coupling pipe (P) is provided at a lower end of a first extension pole 700 and a rotation nut (N) tapered downward is connected to an outer side of a coupling pipe (P), and when a rotation nut (N) is rotated, a second extension pole 800 drawn out by a pressure can be fastened and fixed.

As shown in FIG. 15A and FIG. 15B, a second extension pole 800 is inserted into or withdrawn out of a first extension pole 700 and moves between a first extension pole 700 and a first movement shaft 710, a second latching groove 822*b* is formed on an interior circumference surface along a length direction, and a movement can be locked or unlocked by an engagement of a second fixation ball 732 mounted on a lower ball cover 730.

Specifically, a lower end connection portion 810 is connected to a lower end of the second extension pole 800, a support portion 500 may be coupled to a lower external circumference of a lower end connection portion 810, and a secondary shaft 820 is provided at an upper end to perform an interaction with the lower ball cover 730.

A secondary shaft 820 can be configured by combining a second connection portion 821 and a connection ring 822 that a second latching groove 822*b* is formed on an interior circumference surface 822*a*.

Referring to FIG. 16 and FIG. 17, a length adjustment method of another exemplary embodiment of a length adjustment device according to a present invention will be described.

First, based on FIG. 16, a length adjustment and length fixation between a main pole 600 and a first extension pole 700 will be described. FIG. 16 is an enlarged view "A" part of FIG. 11B.

Referring to (a) of FIG. 16, a first fixation ball 632 of an upper ball cover 630 is disposed and fixed in a first latching groove 711*a* formed on an inner circumference surface 711 of a first movement shaft 710. In this situation, if an user (not shown) press a press button 120 to adjust a length of a length adjustment device, a device is operated as shown in (b) of FIG. 16. That is, referring to (b) of FIG. 16, an operation of a press button 120 causes a lever shaft 610 to descend and a first ball lever portion 640 to descend accordingly, and a first fixation ball 632 of an upper ball cover 630 is released from a first latching groove 711*a* to allow a movement of a first movement shaft 710.

Thereafter, referring to FIG. 16 (*c*), so as to stop and secure a movement of the first movement shaft 710, when a depressing operation of a press button 120 is released, a lever shaft 610 rises and a first ball lever portion 640 rises accordingly, and a first fixation ball 632 of an upper ball cover 630 is inserted into a first latching groove 711*a* to restrict a movement of a first movement shaft 710.

Based on FIG. 17, a length adjustment and length fixation between a first extension pole 700 and a second extension pole 800 will be described. FIG. 17 is an enlarged view of "B" part of FIG. 11B.

Referring to (a) of FIG. 17, a second fixation ball 732 of a lower ball cover 730 is disposed and fixed in a second latching groove 822*b* formed on an interior circumference surface 822*a* of a second movement shaft 820. In this situation, if an user press a press button 120 to adjust a length of a length adjustment device, a device is operated as shown in (b) of FIG. 17. That is, referring to FIG. 17 (*b*), an operation of a press button 120 causes a lever shaft 610 to descend and a first ball lever portion 640 to descend accordingly, a first ball lever portion 640 abuts a second ball lever portion 740 so that a second ball lever portion 740 also descends with a first ball lever portion 640, and a second fixation ball 732 of a lower ball cover 730 moves away from a second latching groove 822*b* to allow a second extension pole 800 to move.

Thereafter, Referring to FIG. 17 (*c*), so as to stop and secure the movement of the second extension pole 800, if a depressing operation of a press button 120 is released, a lever shaft 610 rises and a first ball lever portion 640 rises accordingly, also a second ball lever portion 740 is raised together with a second fixation ball 732 of a lower ball cover 730 being drawn into a second latching groove 822*b* such that a movement of a second extension pole 800 is limited.

As described above, the present invention has been described in detail through a representative embodiment, but it should be understood that the present invention is not limited thereto and is modified or improved by those of ordinary skill in the art within the scope of the present invention. Simple modifications and variations of the present invention belong to the scope of the present invention, and the specific protection range of the present invention will be apparent from the appended claims.

What is claimed is:

1. A length adjustment device, comprising;

a head having a cap forming an outside portion and a press button including a pushing piece that is disposed on the cap to be extended toward a lower side;

a main pole that includes a fixation shaft that is engaged with the cap and an upper end of the fixation shaft is inserted into the cap to be fixed thereto, a lever shaft that is built in the fixation shaft, an upper end portion of the lever shaft is connected with the press button to be lifted or lowered in accordance with a press or a release of the press button, an upper ball cover that is connected with a lower end portion of the fixation shaft and a first fixation ball is mounted on a first fixation hole that penetrates an external circumferential surface of the upper ball cover, a first ball lever portion that is connected with a lower end portion of the lever shaft to be lifted or lowered together and at least a part of an external circumferential surface of the first ball lever portion is formed to be recessed such that the first fixation ball is inserted into or drawn out of the upper ball cover, and an upper return spring that is disposed in the fixation shaft and is disposed between the first ball lever portion and the upper ball cover to return the first ball lever portion; and a first extension pole that includes a first movement shaft disposed between the main pole and the fixation shaft, the first movement shaft configured to be inserted into or out of the main pole and move between the main pole and the fixation shaft, a plurality of first latching grooves are formed on an interior circumference surface of the first movement shaft along a length direction, and the movement of the first fixation shaft is locked or unlocked depending on whether the first fixation ball mounted on the upper ball cover is latched or not, a lower ball cover that is attached to a lower end of the first movement shaft and is fitted with a second fixation ball in a second fixation hole penetrated on an external circumferential surface of the lower ball cover, a second ball lever portion that is installed under the latching groove inside the first movement shaft and contacts the first ball lever portion to move up and down together and at least a portion of an external circumferential surface of the second ball lever portion is recessed so that the second fixation ball is inserted into or drawn out of the lower ball cover, and a lower return spring that is disposed between the lower ball cover and the second ball lever portion to return the second ball lever portion.

2. The length adjustment device of claim 1, wherein the press button includes a lock piece that is extended to a lower direction and is disposed to be parallel to the pushing piece, and the head further includes a lock button configured to be connected with an external circumferential surface of the pushing piece to allow the lock piece to perform a locking operation or configured to be detached from an external circumferential surface of the pushing piece to prevent the lock piece from performing an opening operation.

3. The length adjustment device of claim 2, wherein the cap includes an upper mounting groove on which the press button is disposed, a lower mounting groove that an upper end portion of the fixation shaft is inserted to be fixed thereto, a fastening portion disposed at a lower portion of the cap and the main pole is coupled to, a drawing hole that one end portion of the lock button is drawn out, and a webbing groove that a webbing strap is coupled to.

4. The length adjustment device of claim 3, wherein the webbing strap includes an adjustment portion for adjusting a length of each side of the webbing strap.

5. The length adjustment device of claim 1, wherein the first and second fixation grooves and the first and second fixation balls have a circular arc shape.

* * * * *